US008454385B2

(12) United States Patent
Chawgo et al.

(10) Patent No.: US 8,454,385 B2
(45) Date of Patent: Jun. 4, 2013

(54) COAXIAL CABLE CONNECTOR WITH STRAIN RELIEF CLAMP

(75) Inventors: Shawn M. Chawgo, Cicero, NY (US); Brian K. Hanson, East Syracuse, NY (US); Christopher Philip Natoli, Fulton, NY (US)

(73) Assignee: John Mezzalingua Associates, LLC, East Syracuse, NY (US)

( * ) Notice: Subject to any disclaimer, the term of this patent is extended or adjusted under 35 U.S.C. 154(b) by 327 days.

(21) Appl. No.: 12/889,913

(22) Filed: Sep. 24, 2010

(65) Prior Publication Data

US 2011/0312210 A1 Dec. 22, 2011

Related U.S. Application Data

(60) Provisional application No. 61/357,460, filed on Jun. 22, 2010.

(51) Int. Cl.
*H01R 9/05* (2006.01)

(52) U.S. Cl.
USPC ..... 439/584; 439/271

(58) Field of Classification Search
USPC ..... 439/271, 578, 584, 585
See application file for complete search history.

(56) References Cited

U.S. PATENT DOCUMENTS

| | | | |
|---|---|---|---|
| 3,076,158 | A | 1/1963 | Edelman |
| 4,963,104 | A | 10/1990 | Dickie |
| 5,030,111 | A | 7/1991 | Eastman |
| 6,095,858 | A | 8/2000 | Emery |
| 6,210,222 | B1 | 4/2001 | Langham et al. |
| 6,264,503 | B1 | 7/2001 | Emery |
| 6,817,897 | B2 | 11/2004 | Chee |
| 6,830,479 | B2 | 12/2004 | Holliday |
| 6,976,872 | B1 | 12/2005 | Wild et al. |
| 7,029,326 | B2 | 4/2006 | Montena |
| 7,048,579 | B2 | 5/2006 | Montena |
| 7,131,868 | B2 | 11/2006 | Montena |
| 7,189,115 | B1 | 3/2007 | Montena |
| 7,354,307 | B2 | 4/2008 | Chee |
| 7,422,479 | B2 | 9/2008 | Chee et al. |

(Continued)

FOREIGN PATENT DOCUMENTS

| | | |
|---|---|---|
| EP | 629887 A1 | 12/1994 |
| JP | 2000-150081 | 5/2000 |

OTHER PUBLICATIONS

Natoli, Christopher Philip, Strain Relief Accessory for Coaxial Cable Connector, U.S. Appl. No. 12/889,990, filed Sep. 24, 2010.

(Continued)

*Primary Examiner* — James Harvey
(74) *Attorney, Agent, or Firm* — Schmeiser, Olsen & Watts, LLP

(57) ABSTRACT

Coaxial cable connectors with a strain relief clamp. In one example embodiment, a coaxial cable connector for terminating a coaxial cable is provided. The coaxial cable includes an inner conductor, an insulating layer surrounding the inner conductor, an outer conductor surrounding the insulating layer, and a jacket surrounding the outer conductor. The coaxial cable connector includes an inner conductor clamp configured to engage the inner conductor, an outer conductor clamp configured to engage the outer conductor, a strain relief clamp configured to exert a first inwardly-directed radial force against the coaxial cable, and a moisture seal configured to exert a second inwardly-directed radial force against the jacket. The first force is greater than the second force.

20 Claims, 25 Drawing Sheets

U.S. PATENT DOCUMENTS

| | | | | |
|---|---|---|---|---|
| 7,458,851 | B2 | 12/2008 | Montena | |
| 7,462,069 | B2 | 12/2008 | Studerus | |
| 7,568,945 | B2 | 8/2009 | Chee et al. | |
| 7,934,954 | B1 * | 5/2011 | Chawgo et al. | 439/578 |
| 7,993,159 | B2 * | 8/2011 | Chawgo | 439/584 |
| 8,007,314 | B2 * | 8/2011 | Chawgo et al. | 439/548 |
| 8,177,583 | B2 * | 5/2012 | Chawgo et al. | 439/584 |
| 2010/0022125 | A1 | 1/2010 | Burris et al. | |
| 2011/0244722 | A1 * | 10/2011 | Chawgo et al. | 439/578 |
| 2011/0312210 | A1 * | 12/2011 | Chawgo et al. | 439/460 |
| 2011/0312211 | A1 | 12/2011 | Natoli | |

OTHER PUBLICATIONS

PCT/US2011/041298. International Search Report and Written Opinion. Date of Mailing: Dec. 22, 2011. 9 pages.

PCT/US2011/041299. International Search Report and Written Opinion. Date of Mailing: Dec. 22, 2011. 8 pages.

* cited by examiner

COAXIAL CABLE CONNECTOR WITH STRAIN RELIEF CLAMP

CROSS-REFERENCE TO A RELATED APPLICATION

This application claims the benefit of U.S. Provisional Patent Application Ser. No. 61/357,460, filed on Jun. 22, 2010, which is incorporated herein by reference in its entirety.

BACKGROUND

Coaxial cable is used to transmit radio frequency (RF) signals in various applications, such as connecting radio transmitters and receivers with their antennas. Coaxial cable typically includes an inner conductor, an insulating layer surrounding the inner conductor, an outer conductor surrounding the insulating layer, and a protective jacket surrounding the outer conductor.

Prior to installation, the two ends of a coaxial cable are generally terminated with a connector. Connectors can generally be classified as either field-installable connectors or factory-installed connectors. While portions of factory-installed connectors are generally soldered or welded to the conductors of the coaxial cable, field-installable connectors are generally attached to the conductors of the coaxial cable via compression delivered by a screw mechanism or a compression tool.

One difficulty with field-installable connectors, such as compression connectors or screw-together connectors, is maintaining acceptable levels of passive intermodulation (PIM). PIM in the terminal sections of a coaxial cable can result from nonlinear and insecure contact between surfaces of various components of the connector. A nonlinear contact between two or more of these surfaces can cause micro arcing or corona discharge between the surfaces, which can result in the creation of interfering RF signals.

For example, some screw-together connectors are designed such that the contact force between the connector and the outer conductor is dependent on a continuing axial holding force of threaded components of the connector. Over time, the threaded components of the connector can inadvertently separate, thus resulting in nonlinear and insecure contact between the connector and the outer conductor.

Further, even relatively secure contact between the connector and the outer conductor of the coaxial cable can be undermined as the coaxial cable is subject to stress, due to high wind or vibration for example, which can result in unacceptably high levels of PIM in terminal sections of the coaxial cable.

Where the coaxial cable is employed on a cellular communications tower, for example, unacceptably high levels of PIM in terminal sections of the coaxial cable and resulting interfering RF signals can disrupt communication between sensitive receiver and transmitter equipment on the tower and lower-powered cellular devices. Disrupted communication can result in dropped calls or severely limited data rates, for example, which can result in dissatisfied customers and customer churn.

Current attempts to solve these difficulties with field-installable connectors generally consist of employing a pre-fabricated jumper cable having a standard length and having factory-installed connectors that are soldered or welded on either end. These soldered or welded connectors generally exhibit stable PIM performance over a wider range of dynamic conditions than current field-installable connectors. These pre-fabricated jumper cables are inconvenient, however, in many applications.

For example, each particular cellular communications tower in a cellular network generally requires various custom lengths of coaxial cable, necessitating the selection of various standard-length jumper cables that is each generally longer than needed, resulting in wasted cable. Also, employing a longer length of cable than is needed results in increased insertion loss in the cable. Further, excessive cable length takes up more space on or around the tower. Moreover, it can be inconvenient for an installation technician to have several lengths of jumper cable on hand instead of a single roll of cable that can be cut to the needed length. Also, factory testing of factory-installed soldered or welded connectors for compliance with impedance matching and PIM standards often reveals a relatively high percentage of non-compliant connectors. This percentage of non-compliant, and therefore unusable, connectors can be as high as about ten percent of the connectors in some manufacturing situations. For all these reasons, employing factory-installed soldered or welded connectors on standard-length jumper cables to solve the above-noted difficulties with field-installable connectors is not an ideal solution.

SUMMARY OF SOME EXAMPLE EMBODIMENTS

In general, example embodiments of the present invention relate to coaxial cable connectors with a strain relief clamp. The example coaxial cable connectors disclosed herein improve mechanical and electrical contacts in coaxial cable terminations, which reduces passive intermodulation (PIM) levels and associated creation of interfering RF signals that emanate from the coaxial cable terminations.

In one example embodiment, a coaxial cable connector for terminating a coaxial cable is provided. The coaxial cable includes an inner conductor, an insulating layer surrounding the inner conductor, an outer conductor surrounding the insulating layer, and a jacket surrounding the outer conductor. The coaxial cable connector includes an inner conductor clamp configured to engage the inner conductor, an outer conductor clamp configured to engage the outer conductor, a strain relief clamp configured to exert a first inwardly-directed radial force against the coaxial cable, and a moisture seal configured to exert a second inwardly-directed radial force against the jacket. The first force is greater than the second force.

In another example embodiment, a coaxial cable connector for terminating a coaxial cable is provided. The coaxial cable includes an inner conductor, an insulating layer surrounding the inner conductor, an outer conductor surrounding the insulating layer, and a jacket surrounding the outer conductor. The coaxial cable connector includes an inner conductor clamp configured to engage the inner conductor, an outer conductor clamp configured to compress the outer conductor against an internal support structure, a moisture seal configured to engage the jacket, and a strain relief clamp configured to engage the coaxial cable. The strain relief clamp does not surround any portion of the internal support structure.

In yet another example embodiment, a coaxial cable connector for terminating a coaxial cable is provided. The coaxial cable includes an inner conductor, an insulating layer surrounding the inner conductor, an outer conductor surrounding the insulating layer, and a jacket surrounding the outer conductor. The coaxial cable connector includes an inner conductor clamp configured to engage the inner conductor, an outer conductor clamp configured to compress the outer conductor against an internal support structure, a strain relief clamp configured to exert a first inwardly-directed radial force against the jacket, and a moisture seal configured to exert a second inwardly-directed radial force against the jacket. The first force is greater than the second force. The strain relief clamp does not surround any portion of the internal support structure.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to coaxial cable connectors with a strain relief clamp. The example coaxial cable connectors disclosed herein improve mechanical and electrical contacts in coaxial cable terminations, which reduces passive intermodulation (PIM) levels and associated creation of interfering RF signals that emanate from the coaxial cable terminations.

In the following detailed description of some example embodiments, reference will now be made in detail to example embodiments of the present invention which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. Example Coaxial Cable and Example Compression Connector

Figure 1A:
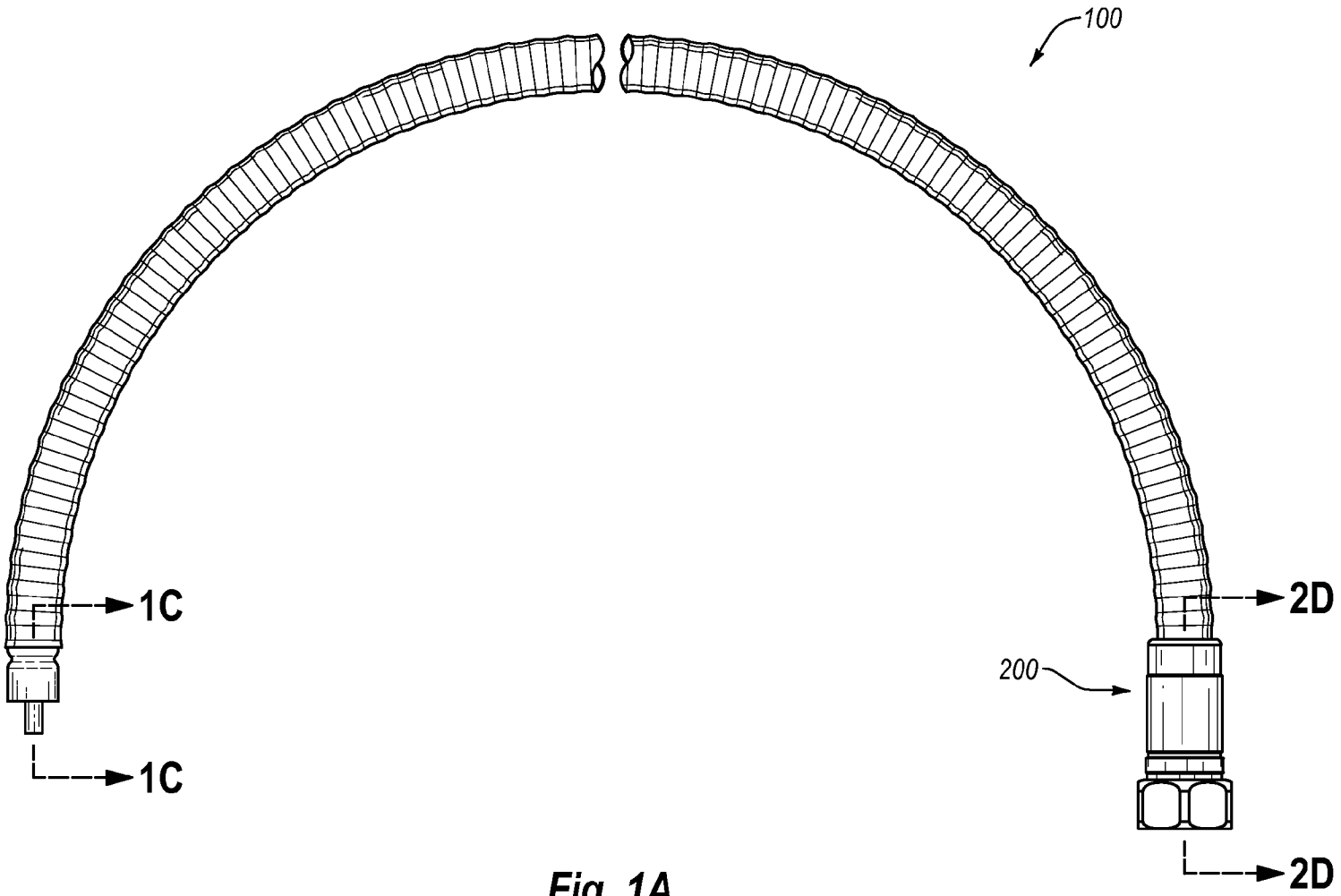
FIG. 1A is a perspective view of an example corrugated coaxial cable terminated on one end with an example compression connector.

With reference now to FIG. 1A, an example coaxial cable 100 is disclosed. The example coaxial cable 100 has 50 Ohms of impedance and is a ½" series corrugated coaxial cable. It is understood, however, that these cable characteristics are example characteristics only, and that the example compression connectors disclosed herein can also benefit coaxial cables with other impedance, dimension, and shape characteristics.

Also disclosed in FIG. 1A, the example coaxial cable 100 is terminated on the right side of FIG. 1A with an example compression connector 200. Although the example compression connector 200 is disclosed in FIG. 1A as a male compression connector, it is understood that the compression connector 200 can instead be configured as a female compression connector (not shown).

Figure 1B:
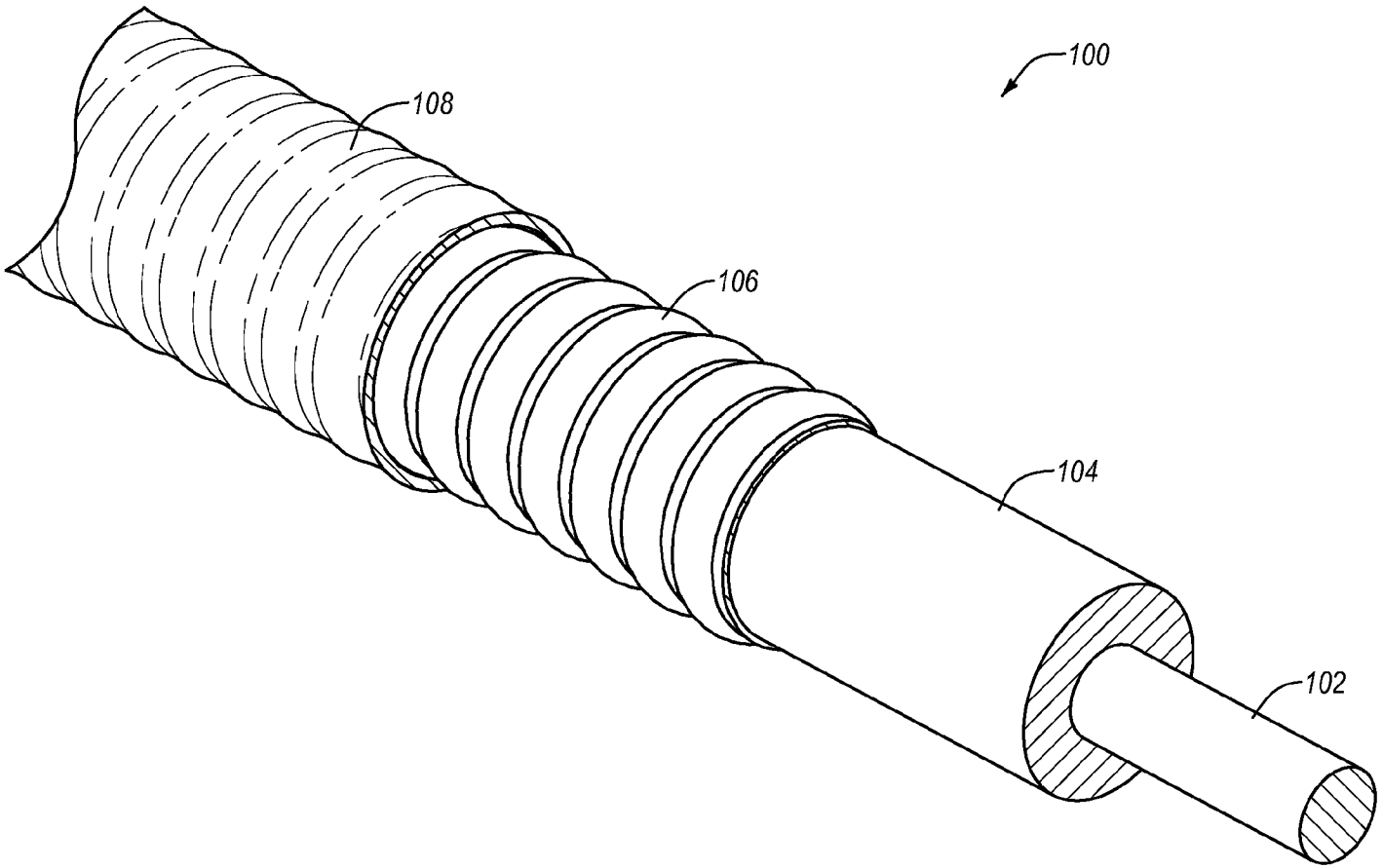
FIG. 1B is a perspective view of a portion of the example corrugated coaxial cable of FIG. 1A, the perspective view having portions of each layer of the example corrugated coaxial cable cut away.

With reference now to FIG. 1B, the coaxial cable 100 generally includes an inner conductor 102 surrounded by an insulating layer 104, an outer conductor 106 surrounding the insulating layer 104, and a jacket 108 surrounding the outer conductor 106. As used herein, the phrase "surrounded by" refers to an inner layer generally being encased by an outer layer. However, it is understood that an inner layer may be "surrounded by" an outer layer without the inner layer being immediately adjacent to the outer layer. The term "surrounded by" thus allows for the possibility of intervening layers. Each of these components of the example coaxial cable 100 will now be discussed in turn.

The inner conductor 102 is positioned at the core of the example coaxial cable 100 and may be configured to carry a range of electrical current (amperes) and/or RF/electronic digital signals. The inner conductor 102 can be formed from copper, copper-clad aluminum (CCA), copper-clad steel (CCS), or silver-coated copper-clad steel (SCCCS), although other conductive materials are also possible. For example, the inner conductor 102 can be formed from any type of conductive metal or alloy. In addition, although the inner conductor 102 of FIG. 1B is clad, it could instead have other configurations such as solid, stranded, corrugated, plated, or hollow, for example.

The insulating layer 104 surrounds the inner conductor 102, and generally serves to support the inner conductor 102 and insulate the inner conductor 102 from the outer conductor 106. Although not shown in the figures, a bonding agent, such as a polymer, may be employed to bond the insulating layer 104 to the inner conductor 102. As disclosed in FIG. 1B, the insulating layer 104 is formed from a foamed material such as, but not limited to, a foamed polymer or fluoropolymer. For example, the insulating layer 104 can be formed from foamed polyethylene.

Although not shown in the figures, it is understood that the insulating layer 104 can be formed from other types of insulating materials or structures having a dielectric constant that is sufficient to insulate the inner conductor 102 from the outer conductor 106. For example, an alternative insulating layer may be composed of a spiral-shaped spacer that enables the inner conductor 102 to be generally separated from the outer conductor 106 by air. The spiral-shaped spacer of the alternative insulating layer may be formed from polyethylene or polypropylene, for example. The combined dielectric constant of the spiral-shaped spacer and the air in the alternative insulating layer would be sufficient to insulate the inner conductor 102 from the outer conductor 106.

The outer conductor 106 surrounds the insulating layer 104, and generally serves to minimize the ingress and egress of high frequency electromagnetic radiation to/from the inner conductor 102. In some applications, high frequency electromagnetic radiation is radiation with a frequency that is greater than or equal to about 50 MHz. The outer conductor 106 can be formed from solid copper, solid aluminum, or copper-clad aluminum (CCA), although other conductive materials are also possible. The corrugated configuration of the outer conductor 106, with peaks and valleys, enables the coaxial cable 100 to be flexed more easily than cables with smooth-walled outer conductors. In addition, it is understood that the corrugations of the outer conductor 106 can be either annular, as disclosed in the figures, or can be helical (not shown).

The jacket 108 surrounds the outer conductor 106, and generally serves to protect the internal components of the coaxial cable 100 from external contaminants, such as dust, moisture, and oils, for example. In a typical embodiment, the jacket 108 also functions to limit the bending radius of the cable to prevent kinking, and functions to protect the cable (and its internal components) from being crushed or otherwise misshapen from an external force. The jacket 108 can be formed from a variety of materials including, but not limited to, polyethylene, high-density polyethylene, low-density polyethylene, linear low-density polyethylene, rubberized polyvinyl chloride, or some combination thereof. The actual material used in the formation of the jacket 108 might be indicated by the particular application/environment contemplated.

Figure 1C:
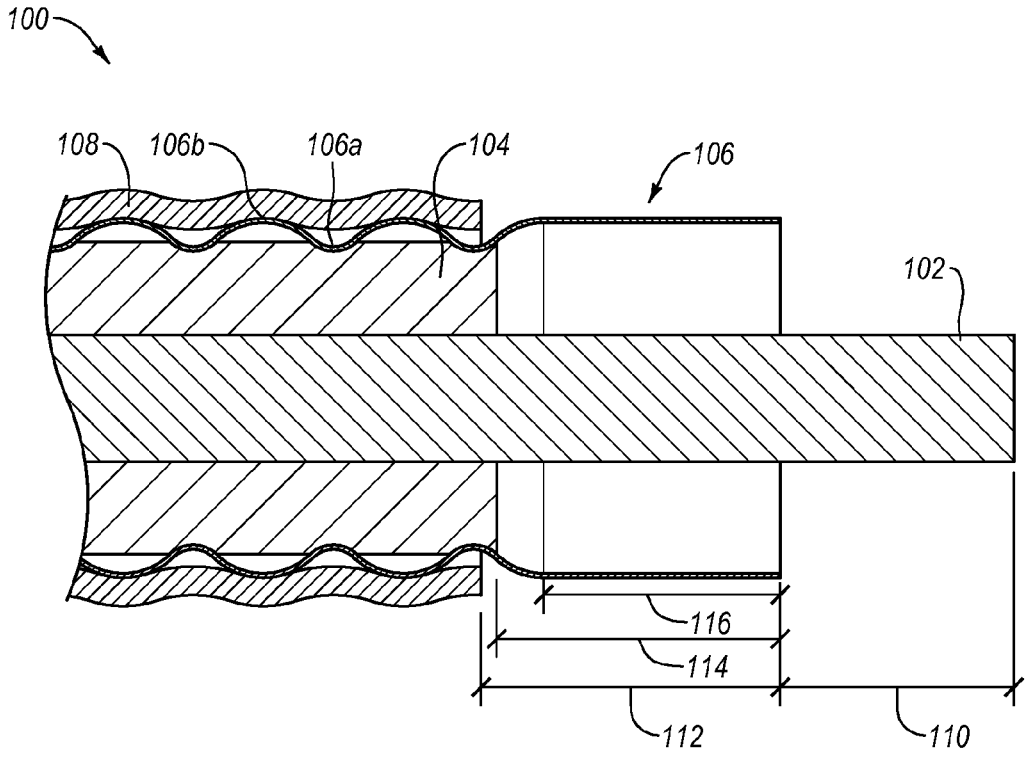
FIG. 1C is a cross-sectional side view of a terminal end of the example corrugated coaxial cable of FIG. 1A after having been prepared for termination with the example compression connector of FIG. 1A.

With reference to FIG. 1C, a terminal end of the coaxial cable 100 is disclosed after having been prepared for termination with the example compression connector 200, disclosed in FIGS. 1A and 2A-2D. As disclosed in FIG. 1C, the terminal end of the coaxial cable 100 includes a first section 110, a second section 112, a cored-out section 114, and an increased-diameter cylindrical section 116. The jacket 108, outer conductor 106, and insulating layer 104 have been stripped away from the first section 110. The jacket 108 has been stripped away from the second section 112. The insulating layer 104 has been cored out from the cored-out section 114. The diameter of a portion of the outer conductor 106 that surrounds the cored-out section 114 has been increased so as to create the increased-diameter cylindrical section 116 of the outer conductor 106.

II. Example Compression Connector

With reference now to FIGS. 2A-2D, additional aspects of the example compression connector 200 are disclosed. As disclosed in FIGS. 2A-2B, the example compression connector 200 includes a first o-ring seal 210, a connector body 220, a connector nut 230, a second o-ring seal 240, a third o-ring seal 250, an insulator 260, a conductive pin 270, a driver 280, a mandrel 290, a clamp 300, a washer 310, a strain relief clamp 320, a strain relief ring 330, a moisture seal 340, and a compression sleeve 350. As disclosed in FIG. 2B, the clamp 300 defines a slot 302 running the length of the clamp 300. Similarly, the strain relief clamp 320 defines a slot 322 running the length of the strain relief clamp 320. The strain relief clamp 320 also defines an engagement surface 324.

Figure 2A:
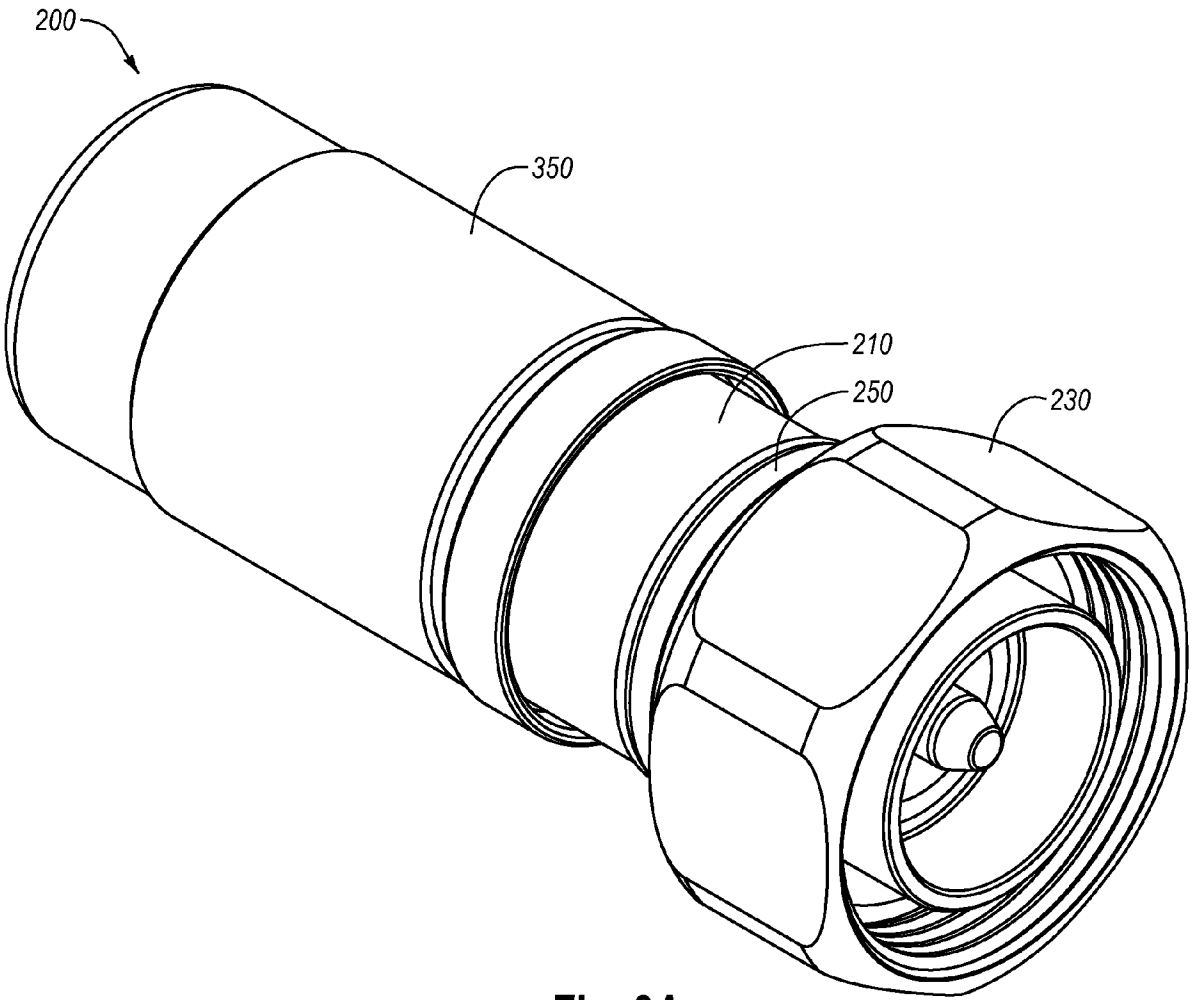
FIG. 2A is a perspective view of the example compression connector of FIG. 1A, with the example compression connector being in an open position.
Figure 2B:
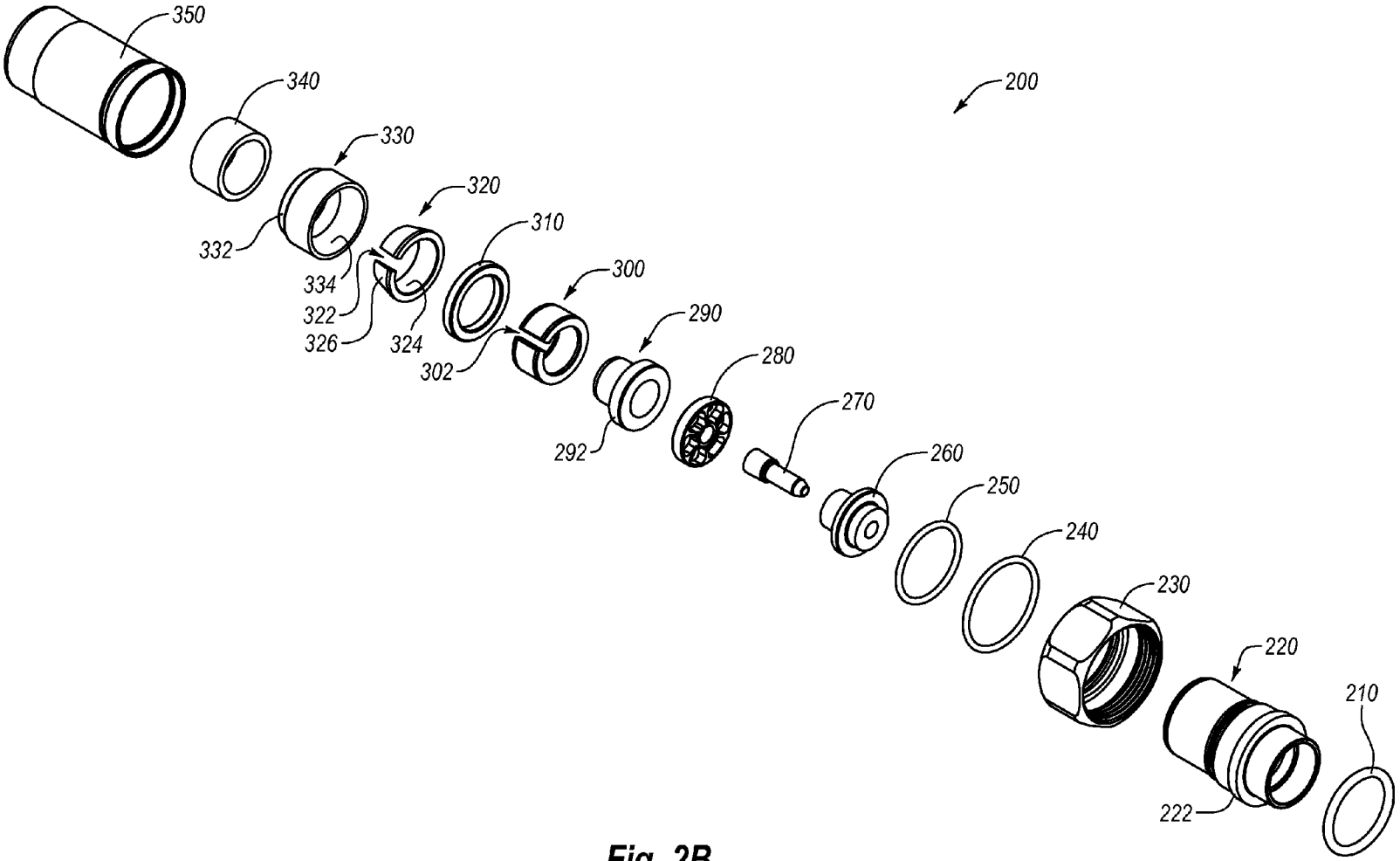
FIG. 2B is an exploded view of the example compression connector of FIG. 2A.
Figure 2C:
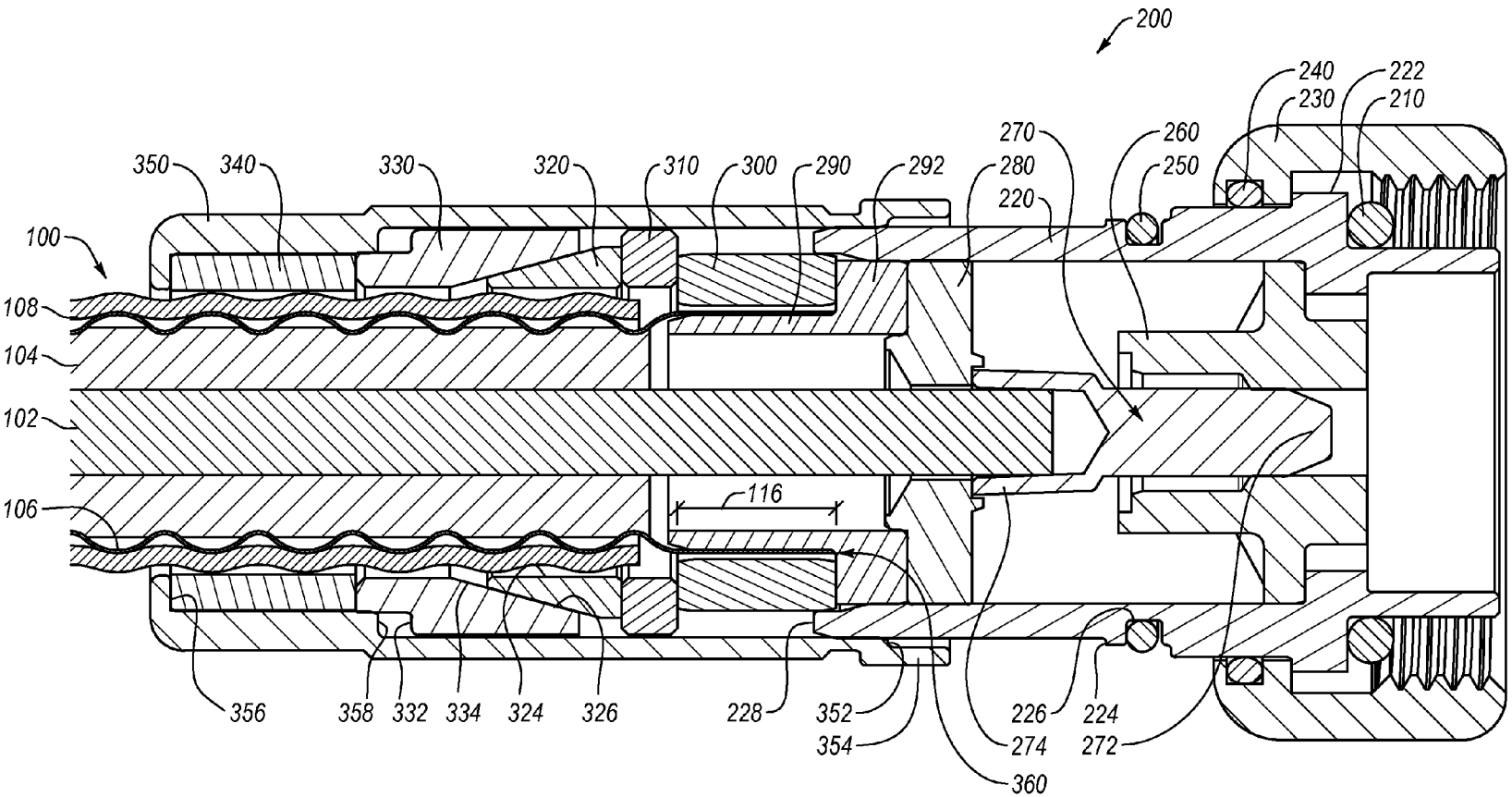
FIG. 2C is a cross-sectional side view of the terminal end of the example corrugated coaxial cable of FIG. 1C after having been inserted into the example compression connector of FIG. 2A, with the example compression connector being in an open position.

As disclosed in FIG. 2C, the connector nut 230 is connected to the connector body 220 via an annular flange 222. The insulator 260 positions and holds the conductive pin 270 within the connector body 220. The conductive pin 270 includes a pin portion 272 at one end and a clamp portion 274 at the other end. The driver 280 is positioned inside the connector body 220 between the clamp portion 274 of the conductive pin 270 and a flange 292 of the mandrel 290. The flange 292 of the mandrel 290 abuts the clamp 300. The clamp 300 abuts the washer 310. The washer 310 abuts the strain relief clamp 320, which is at least partially surrounded by the strain relief ring 330, which abuts the moisture seal 340, all of which are positioned within the compression sleeve 350. In at least some example embodiments, the washer 310 and the strain relief ring 330 are formed from brass.

Figure 2D:
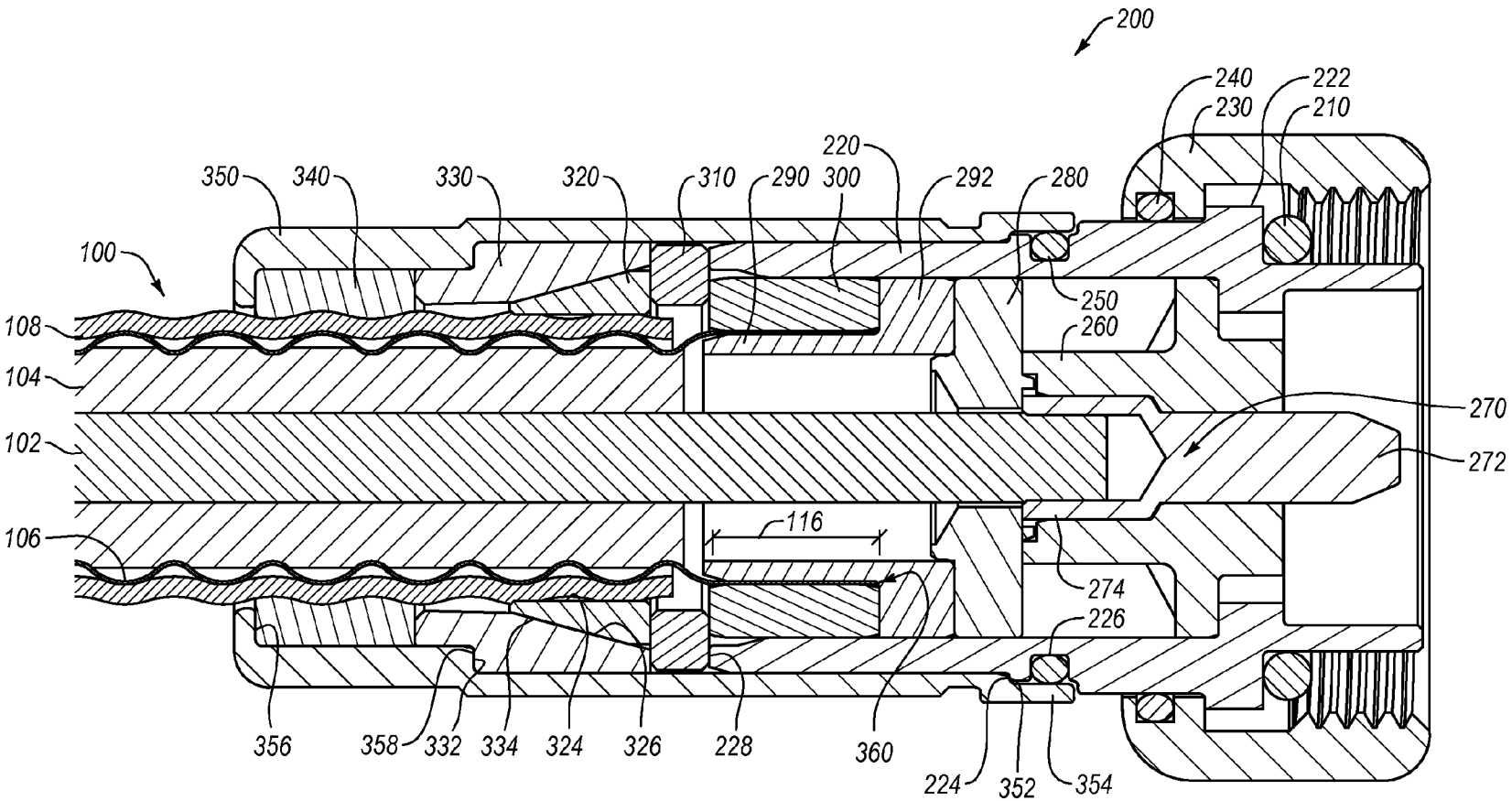
FIG. 2D is a cross-sectional side view of the terminal end of the example corrugated coaxial cable of FIG. 1C after having been inserted into the example compression connector of FIG. 2A, with the example compression connector being in an engaged position.

With reference now to FIGS. 2C and 2D, additional aspects of the operation of the example compression connector 200 are disclosed. FIG. 2C discloses the example compression connector 200 in an initial open position, while FIG. 2D discloses the example compression connector 200 after having been moved into an engaged position.

As disclosed in FIG. 2C, the terminal end of the coaxial cable 100 of FIG. 1C can be inserted into the example compression connector 200 through the compression sleeve 350. Once inserted, the increased-diameter cylindrical section 116 of the outer conductor 106 is received into the cylindrical gap 360 defined between the mandrel 290 and the clamp 300. Also, once inserted, the inner conductor 102 is received into the clamp portion 274 of the conductive pin 270 such that the conductive pin 270 is mechanically and electrically contacting the inner conductor 102. Further, once inserted, the strain relief clamp 320 and the moisture seal 340 surround the jacket 108 of the coaxial cable 100.

As disclosed in FIGS. 2C and 2D, the example compression connector 200 is moved into the engaged position by sliding the compression sleeve 350 axially along the connector body 220 toward the connector nut 230 until a shoulder 352 of the compression sleeve 350 abuts a shoulder 224 of the connector body 220. In addition, a distal end 354 of the compression sleeve 350 compresses the third o-ring seal 250 into an annular groove 226 defined in the connector body 220, thus sealing the compression sleeve 350 to the connector body 220.

Further, as the compression connector 200 is moved into the engaged position, a shoulder 356 of the compression sleeve 350 axially biases against the moisture seal 340, which axially biases against the strain relief ring 330, which axially biases against the strain relief clamp 320, which axially biases against the washer 310, which axially forces the clamp 300 into the smaller-diameter connector body 220, which radially compresses the clamp 300 around the increased-diameter cylindrical section 116 of the outer conductor 106 by narrowing or closing the slot 302 (see FIG. 2B). The compression of the clamp 300 radially compresses the increased-diameter cylindrical section 116 between the clamp 300 and the mandrel 290. The mandrel 290 is therefore an example of an internal connector structure as at least a portion of the mandrel 290 is configured to be positioned internal to the coaxial cable 100.

In addition, as the compression connector 200 is moved into the engaged position, the clamp 300 axially biases against an annular flange 292 of the mandrel 290, which axially biases against the driver 280, which axially forces the clamp portion 274 of the conductive pin 270 into the smaller-diameter insulator 260, which radially compresses the clamp portion 274 around the inner conductor 102. Further, the pin portion 272 of the conductive pin 270 extends past the insulator 260 in order to engage a corresponding conductor of a female connector (not shown) once engaged with the connector nut 230.

Also, as the compression connector 200 is moved into the engaged position, the distal end 228 of the connector body 220 axially biases against the washer 310, which axially biases against the strain relief clamp 320, which axially biases against the strain relief ring 330, which axially biases against the moisture seal 340 until a shoulder 332 of the strain relief ring 330 abuts a shoulder 358 of the compression sleeve 350. The axial force of the strain relief ring 330 combined with the opposite axial force of the washer 310 forces a tapered surface 326 of the strain relief clamp 320 to interact with a corresponding tapered surface 334 of the strain relief ring 330 in order to exert a first inwardly-directed radial force against the jacket 108 by narrowing or closing the slot 322 (see FIG. 2B). The tapered surface 326 of the strain relief clamp 320 tapers outwardly toward the clamp 300. It is noted that the strain relief clamp 320 does not surround any portion of the mandrel 290 and thus exerts the first inwardly-directed radial force against an internally unsupported portion of the coaxial cable 100.

Moreover, as the compression connector 200 is moved into the engaged position, the strain relief ring 330 axially biases against the moisture seal 340 and thereby axially compresses the moisture seal 340 causing the moisture seal 340 to become shorter in length and thicker in width. The thickened width of the moisture seal 340 causes the moisture seal 340 to exert a second inwardly-directed radial force against the jacket 108 of the coaxial cable 100, thus sealing the compression sleeve 350 to the jacket 108 of the coaxial cable 100.

In at least some example embodiments, the first inwardly-directed radial force is greater than the second inwardly-directed radial force. This difference in force may be due to differences in size and/or shape between the moisture seal 340 and the strain relief clamp 320, and/or due to differences in the deforming forces applied to the moisture seal 340 and the strain relief clamp 320. This difference in force may also, or alternatively, be due, at least in part, to the moisture seal 340 being formed from a material that is softer than the material from which the strain relief clamp 320 is formed. For example, the moisture seal 340 may be formed from a rubber material while the strain relief clamp 320 may be formed from an acetal homopolymer material.

The relative softness of the material from which the moisture seal 340 is formed enables the moisture seal 340 to substantially prevent moisture from entering the example connector 200. For example, even though the surface of the jacket 108 of the coaxial cable 100 may be scraped or pitted, or may have other surface deformities or irregularities, the relatively soft moisture seal 340 is able to substantially seal the surface of the jacket 108 against moisture. Further, even though the cable 100 may bend at the moisture seal 340, and thus further compress the portions of the moisture seal 340 at the inside of the bend while pulling away from the portion of the moisture seal 340 at the outside of the bend, the relatively soft moisture seal 340 enables the portion of the moisture seal 340 at the outside of the bend to expand and continue to seal the surface of the jacket 108 at the outside of the bend against moisture.

After termination and installation of the coaxial cable 100, on a cellular communications tower for example, the mechanical and electrical contacts between the conductors of the coaxial cable 100 and the compression connector 200 may be subject to strain due to, for example, high wind and vibration. The first inwardly-directed radial force exerted by the strain relief clamp 320 relieves strain on the coaxial cable 100 from being transferred to the mechanical and electrical contacts between the outer conductor 106, the clamp 300, and the mandrel 290.

In particular, the inclusion of the strain relief clamp 320, with its first inwardly-directed radial force, substantially prevents the coaxial cable 100 from flexing between the strain relief clamp 320 and the mechanical and electrical contacts between the outer conductor 106, the clamp 300, and the mandrel 290. Instead, the coaxial cable 100 is only allowed to flex beyond the strain relief clamp 320 opposite the clamp 300. Therefore, while the relatively lesser inwardly-directed radial force exerted by the moisture seal 340 may allow strain on the coaxial cable 100 to be transferred past the moisture seal 340 into the connector 200, the relatively greater inwardly-directed radial force exerted by the strain relief clamp 320 substantially prevents strain on the coaxial cable 100 from being transferred past the strain relief clamp 320 to the mechanical and electrical contacts between the outer conductor 106, the clamp 300, and the mandrel 290.

Further, the placement of the strain relief clamp 320 beyond the end of the mandrel 290 so that the strain relief clamp 320 does not surround any portion of the mandrel 290 enables the strain relief clamp 320 to provide greater strain relief than if the strain relief clamp 320 were surrounding some portion of the mandrel 290, and thereby necessarily placed closer to the clamp 300. In general, the further that the strain relief clamp 320 is placed from the clamp 300, the more strain relief is provided to the mechanical and electrical contacts between the outer conductor 106, the clamp 300, and the mandrel 290.

Substantially preventing strain on these mechanical and electrical contacts helps these contacts remain linear and secure, which helps reduce or prevent micro arcing or corona discharge between surfaces, which reduces the PIM levels and associated creation of interfering RF signals that emanate from the example compression connector 200. Advantageously, the example field-installable compression connector 200 exhibits PIM characteristics that match or exceed the corresponding characteristics of less convenient factory-installed soldered or welded connectors on pre-fabricated jumper cables.

III. First Alternative Compression Connector

Figure 3A:
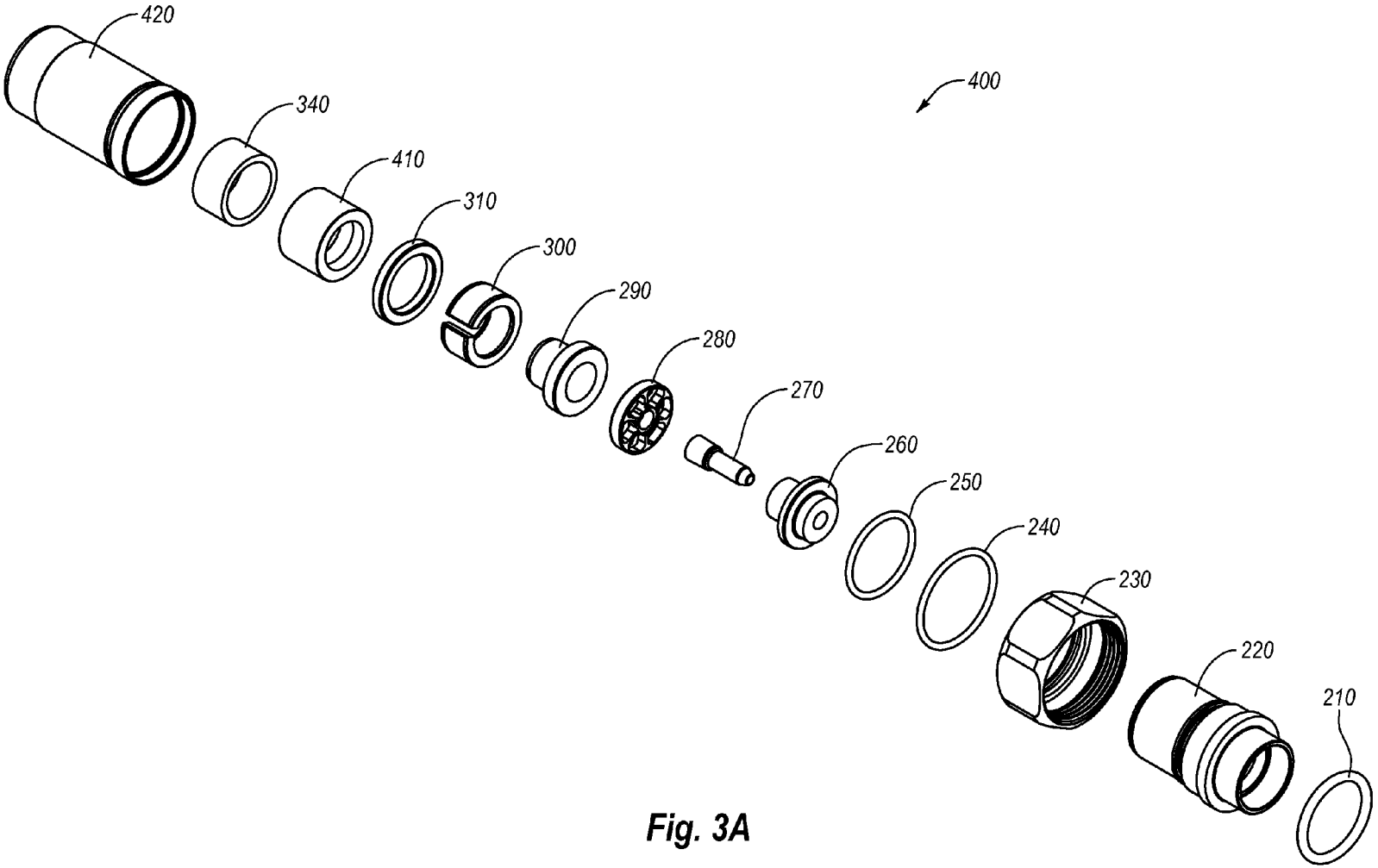
FIG. 3A is an exploded view of a first alternative compression connector.
Figure 3B:
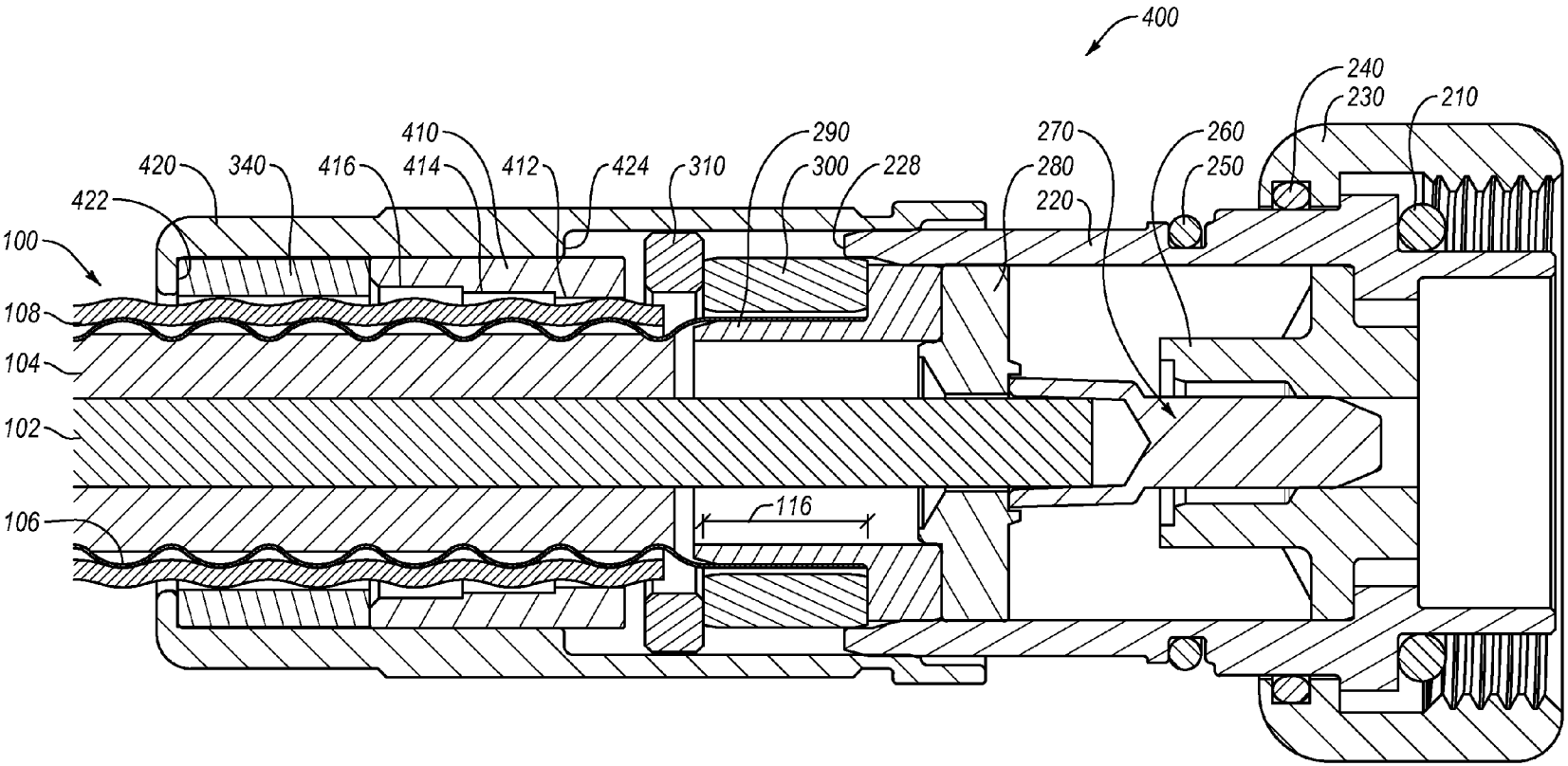
FIG. 3B is a cross-sectional side view of the terminal end of the example corrugated coaxial cable of FIG. 1C after having been inserted into the first alternative compression connector of FIG. 3A, with the first alternative compression connector being in an open position.
Figure 3C:
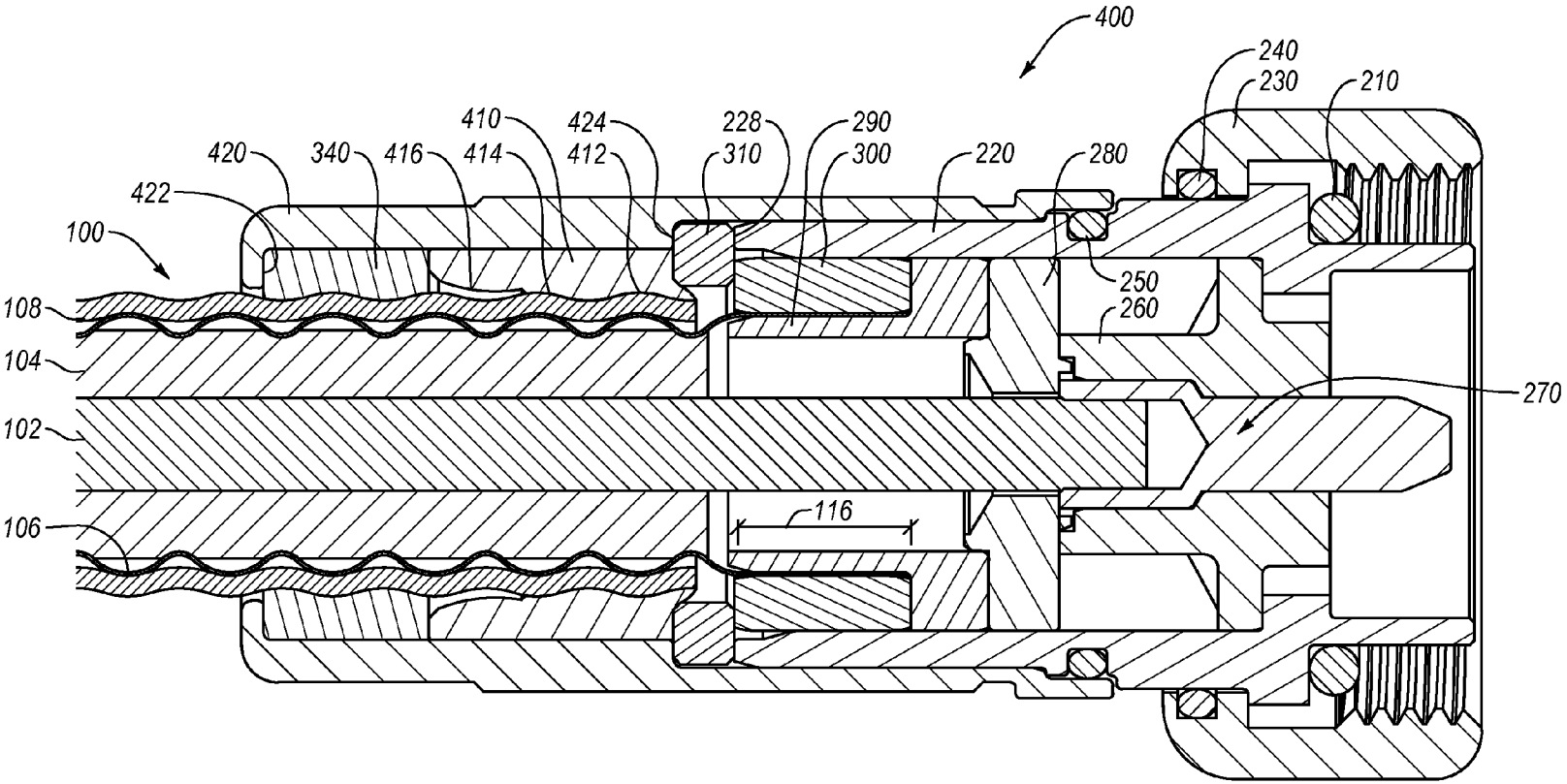
FIG. 3C is a cross-sectional side view of the terminal end of the example corrugated coaxial cable of FIG. 1C after having been inserted into the first alternative compression connector of FIG. 3A, with the first alternative compression connector being in an engaged position.

With reference now to FIGS. 3A-3C, a first alternative compression connector 400 is disclosed. The first alternative compression connector is identical to the compression connector 200 except that the strain relief clamp 320, the strain relief ring 330, and the compression sleeve 350 have been replaced with a strain relief clamp 410 and a compression sleeve 420.

As disclosed in FIG. 3B, the strain relief clamp 410 has a stepped configuration which includes a plurality of stepped engagement surfaces. In particular, the strain relief clamp 410 includes a small diameter engagement surface 412, a medium diameter engagement surface 414, and a large diameter engagement surface 416. In at least some example embodiments, the strain relief clamp 410 is formed from a material that is harder than the material from which the moisture seal 340 is formed. For example, where the moisture seal 340 is formed from a softer rubber material, the strain relief clamp 410 may be formed from a harder rubber material.

With reference now to FIGS. 3B and 3C, additional aspects of the operation of the first alternative compression connector 400 are disclosed. FIG. 3B discloses the first alternative compression connector 400 in an initial open position, while FIG. 3C discloses the first alternative compression connector 400 after having been moved into an engaged position. As most of the components of the first alternative compression connector 400 are identical in form and function to the components of the example compression connector 200, the discussion below will focus primarily on those aspects of the operation of the first alternative compression connector 400 that differ from the operation of the example compression connector 200.

As disclosed in FIG. 3B, the terminal end of the coaxial cable 100 of FIG. 1C can be inserted into the first alternative compression connector 400 through the compression sleeve 420. Once inserted, the strain relief clamp 410 and the moisture seal 340 surround the jacket 108 of the coaxial cable 100.

As disclosed in FIGS. 3B and 3C, the first alternative compression connector 400 is moved into the engaged position by sliding the compression sleeve 420 axially along the connector body 220 toward the connector nut 230. As the first alternative compression connector 400 is moved into the engaged position, a shoulder 422 of the compression sleeve 420 axially biases against the moisture seal 340, which axially biases against the strain relief clamp 410, which axially biases against the washer 310, which axially forces the clamp 300 into the smaller-diameter connector body 220 so as to radially compress the increased-diameter cylindrical section 116 of the outer conductor 106 between the clamp 300 and the mandrel 290.

Also, as the first alternative compression connector 400 is moved into the engaged position, the distal end 228 of the connector body 220 axially biases against the washer 310, which axially biases against the strain relief clamp 410, which axially biases against the moisture seal 340 until a shoulder 424 of the compression sleeve 420 abuts the washer 310. The axial force of the moisture seal 340 combined with the opposite axial force of the washer 310 axially compresses the strain relief clamp 410 causing the strain relief clamp 410 to become shorter in length and thicker in width. The thickened width of the strain relief clamp 410 causes the strain relief clamp 410 to exert a first inwardly-directed radial force against the jacket 108 of the coaxial cable 100.

Moreover, as the first alternative compression connector 400 is moved into the engaged position, the strain relief clamp 410 axially biases against the moisture seal 340 and thereby axially compresses the moisture seal 340 causing the moisture seal 340 to exert a second inwardly-directed radial force against the jacket 108 of the coaxial cable 100, thus sealing the compression sleeve 420 to the jacket 108 of the coaxial cable 100.

In at least some example embodiments, the first inwardly-directed radial force is greater than the second inwardly-directed radial force. This difference in inwardly-directed radial force may be due to any of the various reasons discussed above in connection with the differences in inwardly-directed radial force exerted by the moisture seal 340 and the strain relief clamp 320. The inwardly-directed radial force exerted by the strain relief clamp 410 relieves strain on the coaxial cable 100 from being transferred to the mechanical and electrical contacts between the outer conductor 106, the clamp 300, and the mandrel 290, in a similar fashion as the strain relief clamp 320 discussed above.

IV. Second Alternative Compression Connector

Figure 4A:
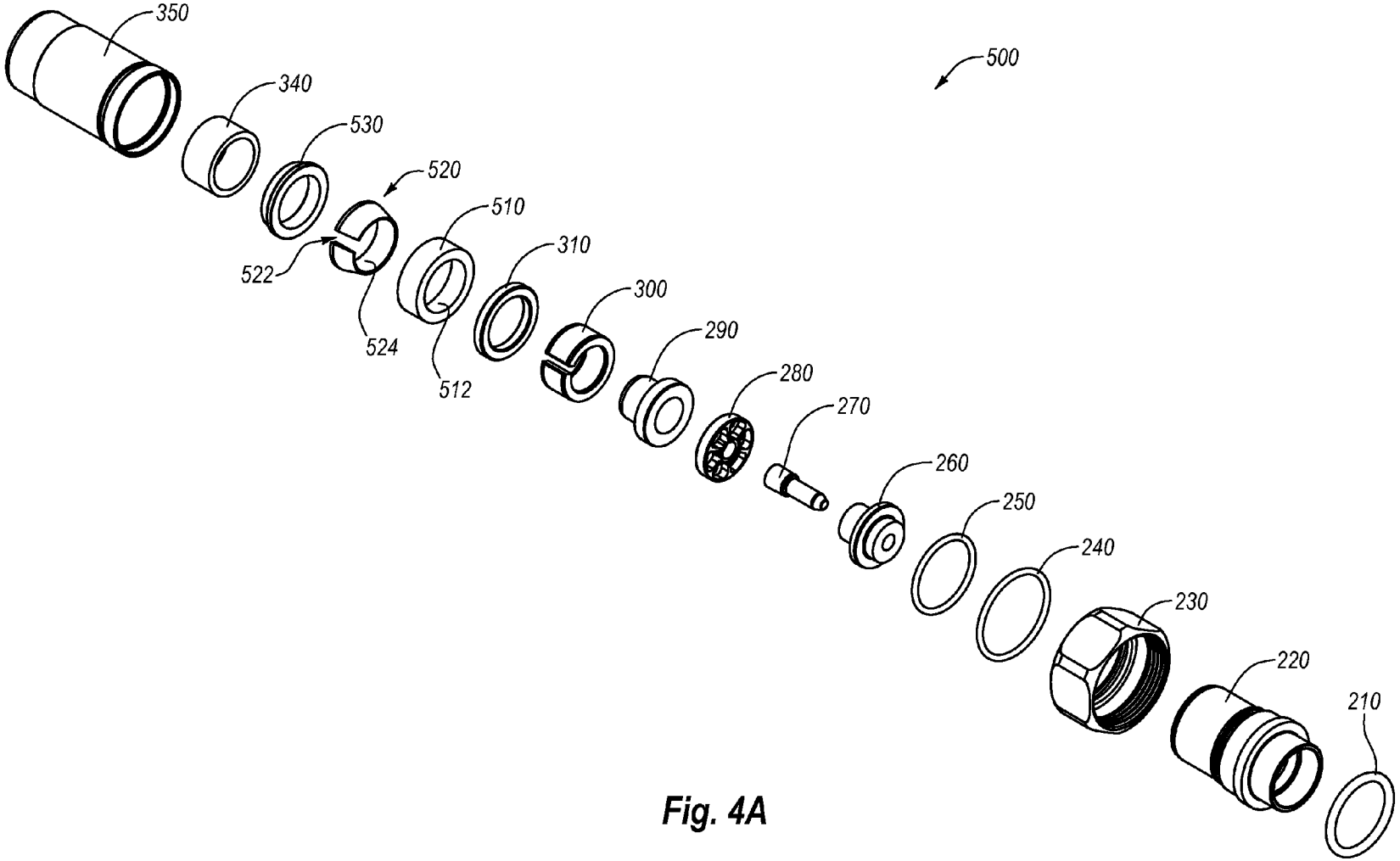
FIG. 4A is an exploded view of a second alternative compression connector.
Figure 4B:
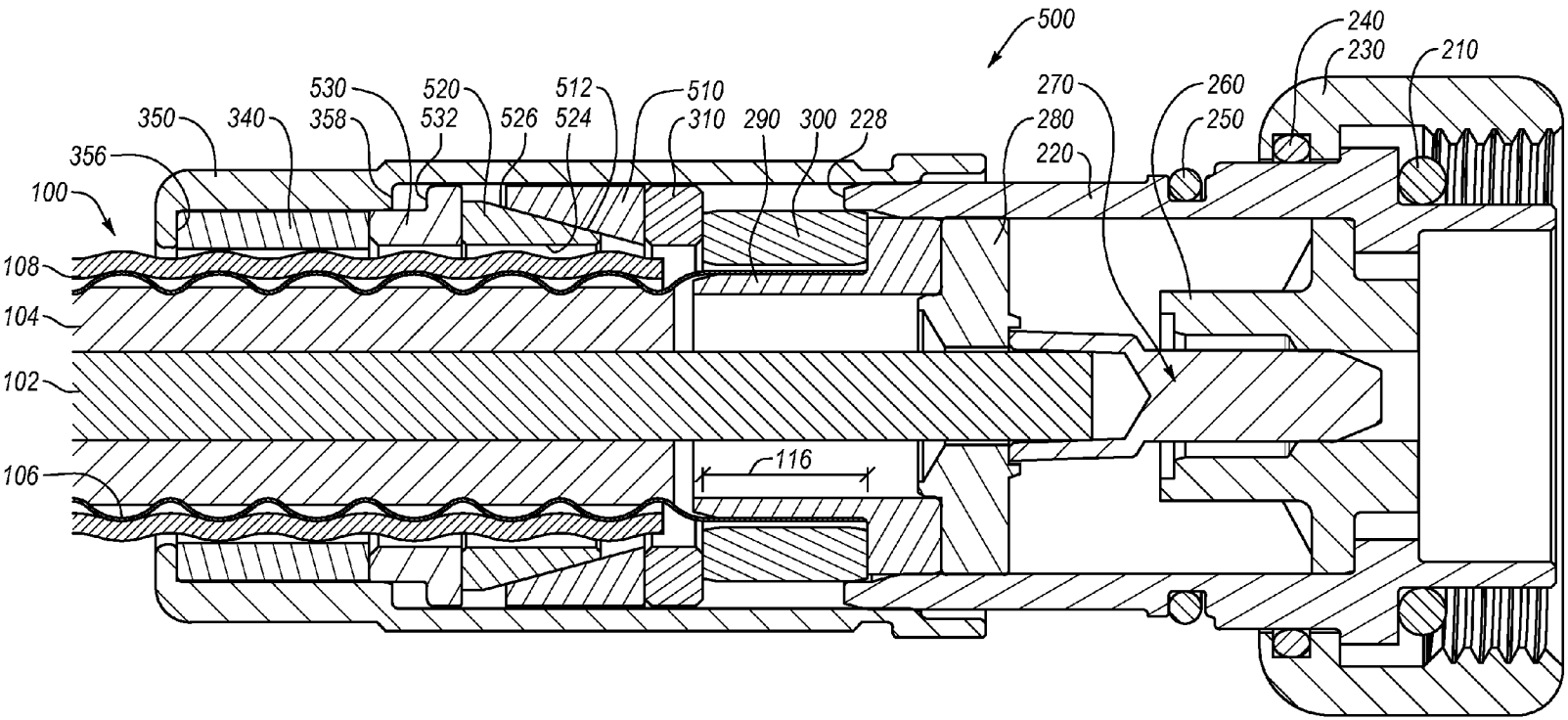
FIG. 4B is a cross-sectional side view of the terminal end of the example corrugated coaxial cable of FIG. 1C after having been inserted into the second alternative compression connector of FIG. 4A, with the second alternative compression connector being in an open position.
Figure 4C:
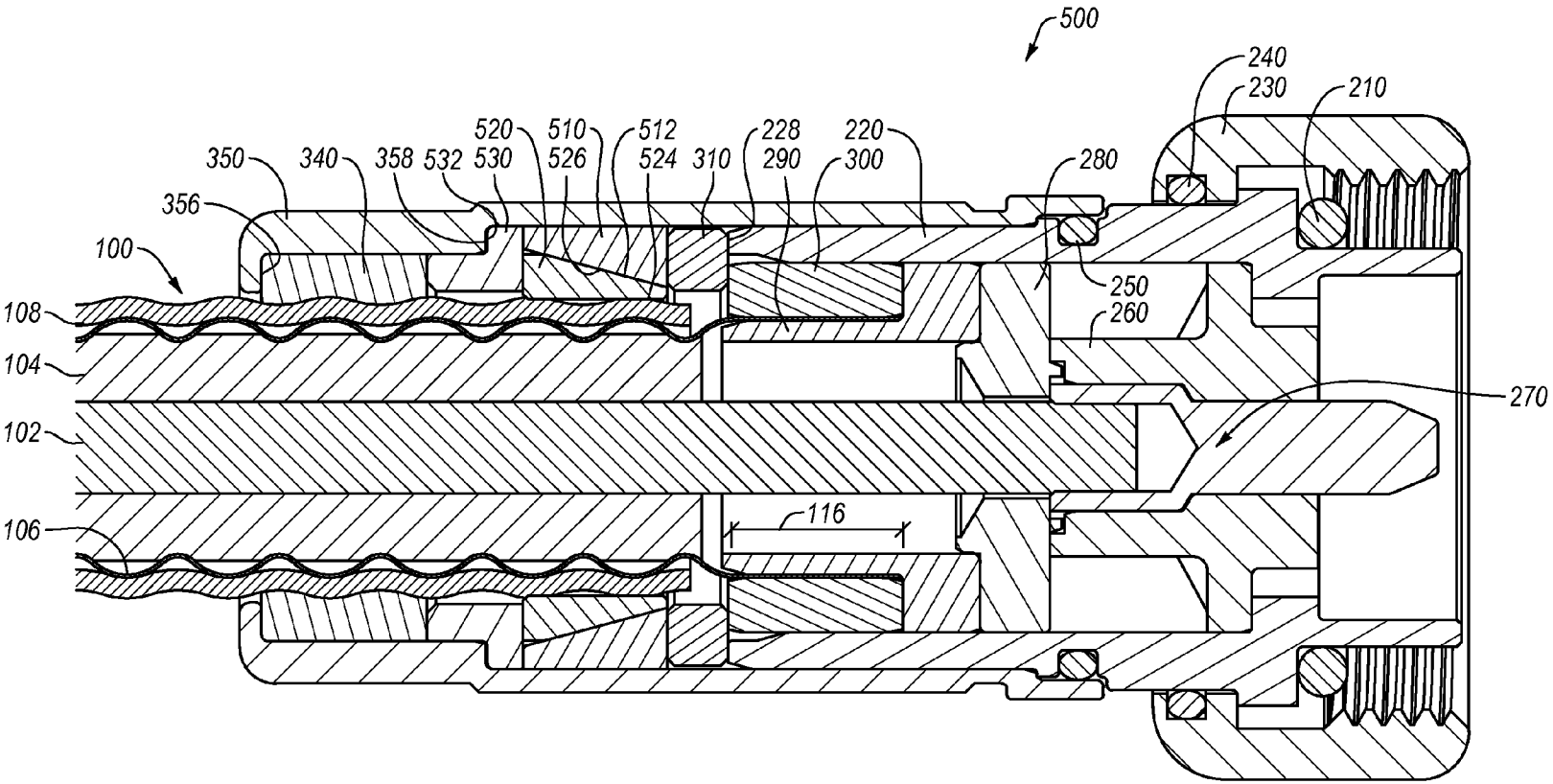
FIG. 4C is a cross-sectional side view of the terminal end of the example corrugated coaxial cable of FIG. 1C after having been inserted into the second alternative compression connector of FIG. 4A, with the second alternative compression connector being in an engaged position.

With reference now to FIGS. 4A-4C, a second alternative compression connector 500 is disclosed. The second alternative compression connector 500 is identical to the compression connector 200 except that the strain relief clamp 320 and the strain relief ring 330 have been replaced with a strain relief ring 510, a strain relief clamp 520, and a moisture seal ring 530.

As disclosed in FIG. 4A, the strain relief clamp 520 defines a slot 522 running the length of the strain relief clamp 520. The strain relief clamp 520 also defines an engagement surface 524. In at least some example embodiments, the moisture seal 340 is formed from a material that is softer than the material from which the strain relief clamp 520 is formed. For example, the moisture seal 340 may be formed from rubber material while the strain relief clamp 520 is formed from an acetal homopolymer material. Further, in at least some example embodiments, the strain relief ring 510 and the moisture seal ring 530 are formed from brass.

With reference now to FIGS. 4B and 4C, additional aspects of the operation of the second alternative compression connector 500 are disclosed. FIG. 4B discloses the second alternative compression connector 500 in an initial open position, while FIG. 4C discloses the second alternative compression connector 500 after having been moved into an engaged position. As most of the components of the second alternative compression connector 500 are identical in form and function to the components of the example compression connector 200, the discussion below will focus primarily on those aspects of the operation of the second alternative compression connector 500 that differ from the operation of the example compression connector 200.

As disclosed in FIG. 4B, the terminal end of the coaxial cable 100 of FIG. 1C can be inserted into the second alternative compression connector 500 through the compression sleeve 350. Once inserted, the strain relief clamp 520 and the moisture seal 340 surround the jacket 108 of the coaxial cable 100.

As disclosed in FIGS. 4B and 4C, the second alternative compression connector 500 is moved into the engaged position by sliding the compression sleeve 350 axially along the connector body 220 toward the connector nut 230. As the second alternative compression connector 500 is moved into the engaged position, the shoulder 356 of the compression sleeve 350 axially biases against the moisture seal 340, which axially biases against the moistures seal ring 530, which axially biases against the strain relief clamp 520, which axially biases against the strain relief ring 510, which axially biases against the washer 310, which axially forces the clamp 300 into the smaller-diameter connector body 220 so as to radially compress the increased-diameter cylindrical section 116 of the outer conductor 106 between the clamp 300 and the mandrel 290.

Also, as the second alternative compression connector 500 is moved into the engaged position, the distal end 228 of the connector body 220 axially biases against the washer 310, which axially biases against the strain relief ring 510, which axially biases against the strain relief clamp 520, which axially biases against the moisture seal ring 530, which axially biases against the moisture seal 340 until the shoulder 358 of the compression sleeve 350 abuts a shoulder 532 of the moisture seal ring 530. The axial force of the moisture seal ring 530 combined with the opposite axial force of the washer 310 axially forces a tapered surface 526 of the strain relief clamp 520 to interact with a corresponding tapered surface 512 of the strain relief ring 510 in order to exert a first inwardly-directed radial force against the jacket 108 by narrowing or closing the slot 522 (see FIG. 4A). The tapered surface 526 of the strain relief clamp 520 tapers inwardly toward the clamp 300.

Moreover, as the second alternative compression connector 500 is moved into the engaged position, the moisture seal ring 530 axially biases against the moisture seal 340 and thereby axially compresses the moisture seal 340 causing the moisture seal 340 to exert a second inwardly-directed radial force against the jacket 108 of the coaxial cable 100, thus sealing the compression sleeve 350 to the jacket 108 of the coaxial cable 100.

In at least some example embodiments, the first inwardly-directed radial force is greater than the second inwardly-directed radial force. This difference in inwardly-directed radial force may be due to any of the various reasons discussed above in connection with the differences in inwardly-directed radial force exerted by the moisture seal 340 and the strain relief clamp 320. The inwardly-directed radial force exerted by the strain relief clamp 520 relieves strain on the coaxial cable 100 from being transferred to the mechanical and electrical contacts between the outer conductor 106, the clamp 300, and the mandrel 290, in a similar fashion as the strain relief clamp 320 discussed above.

V. Third Alternative Compression Connector

Figure 5A:
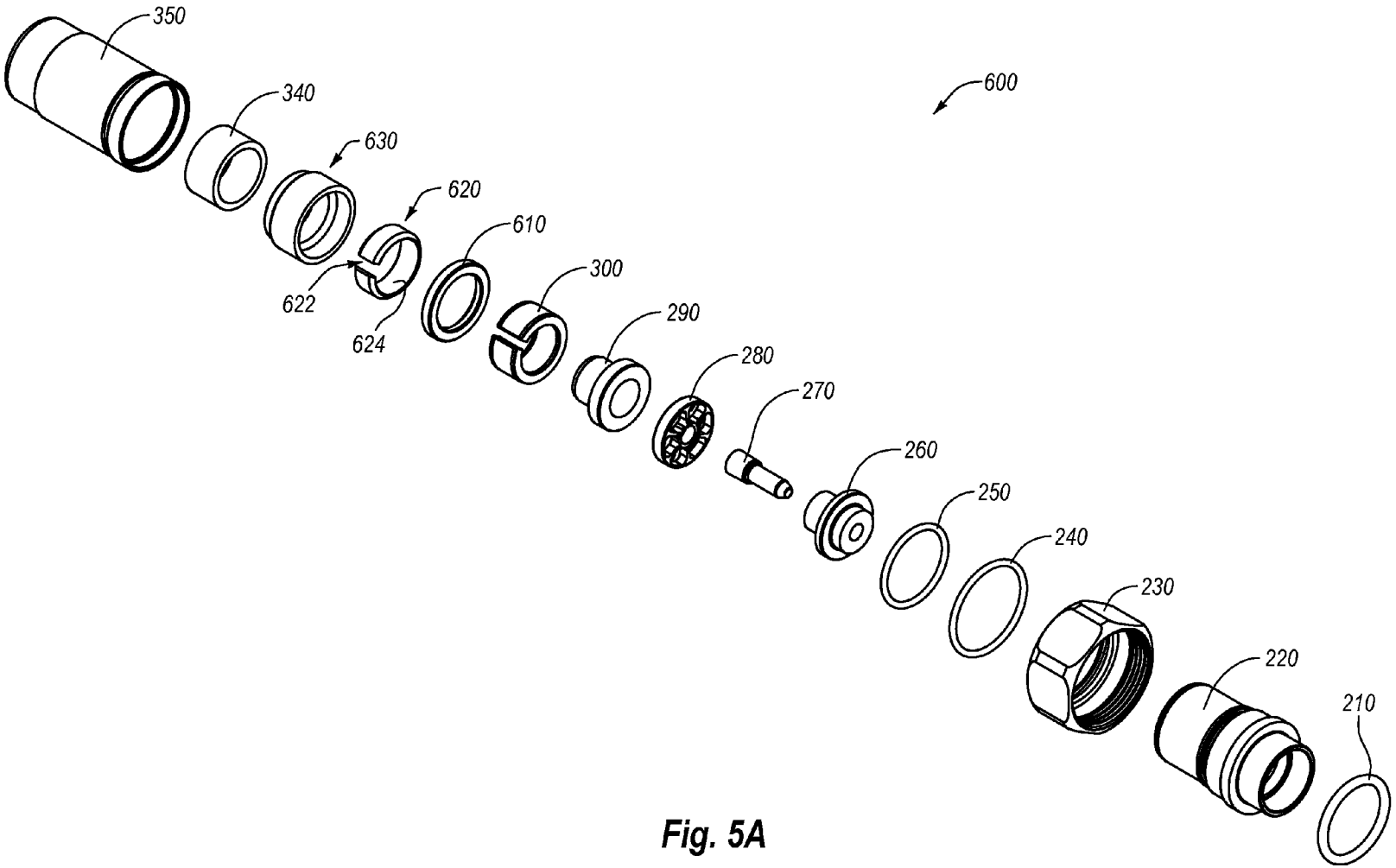
FIG. 5A is an exploded view of a third alternative compression connector.
Figure 5B:
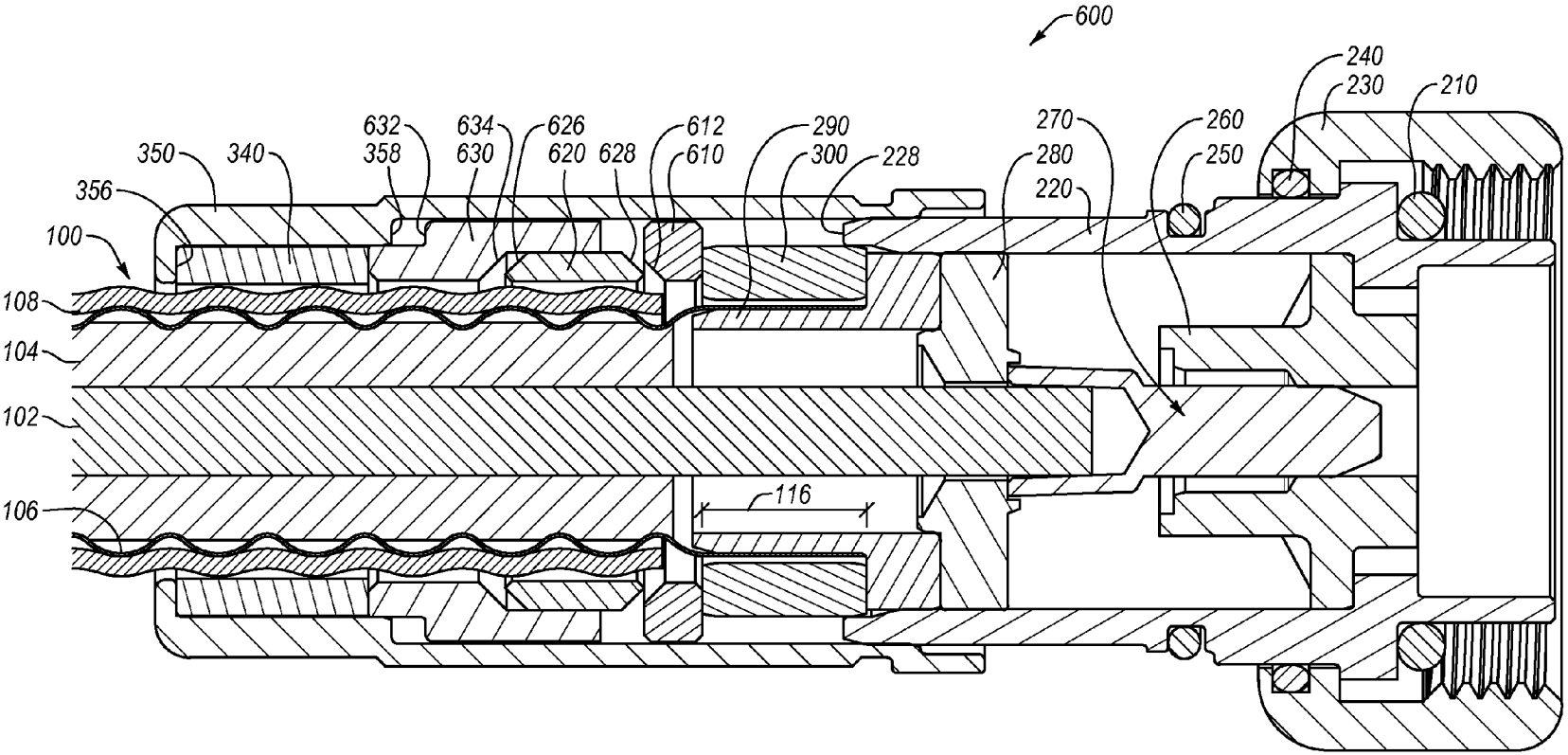
FIG. 5B is a cross-sectional side view of the terminal end of the example corrugated coaxial cable of FIG. 1C after having been inserted into the third alternative compression connector of FIG. 5A, with the third alternative compression connector being in an open position.
Figure 5C:
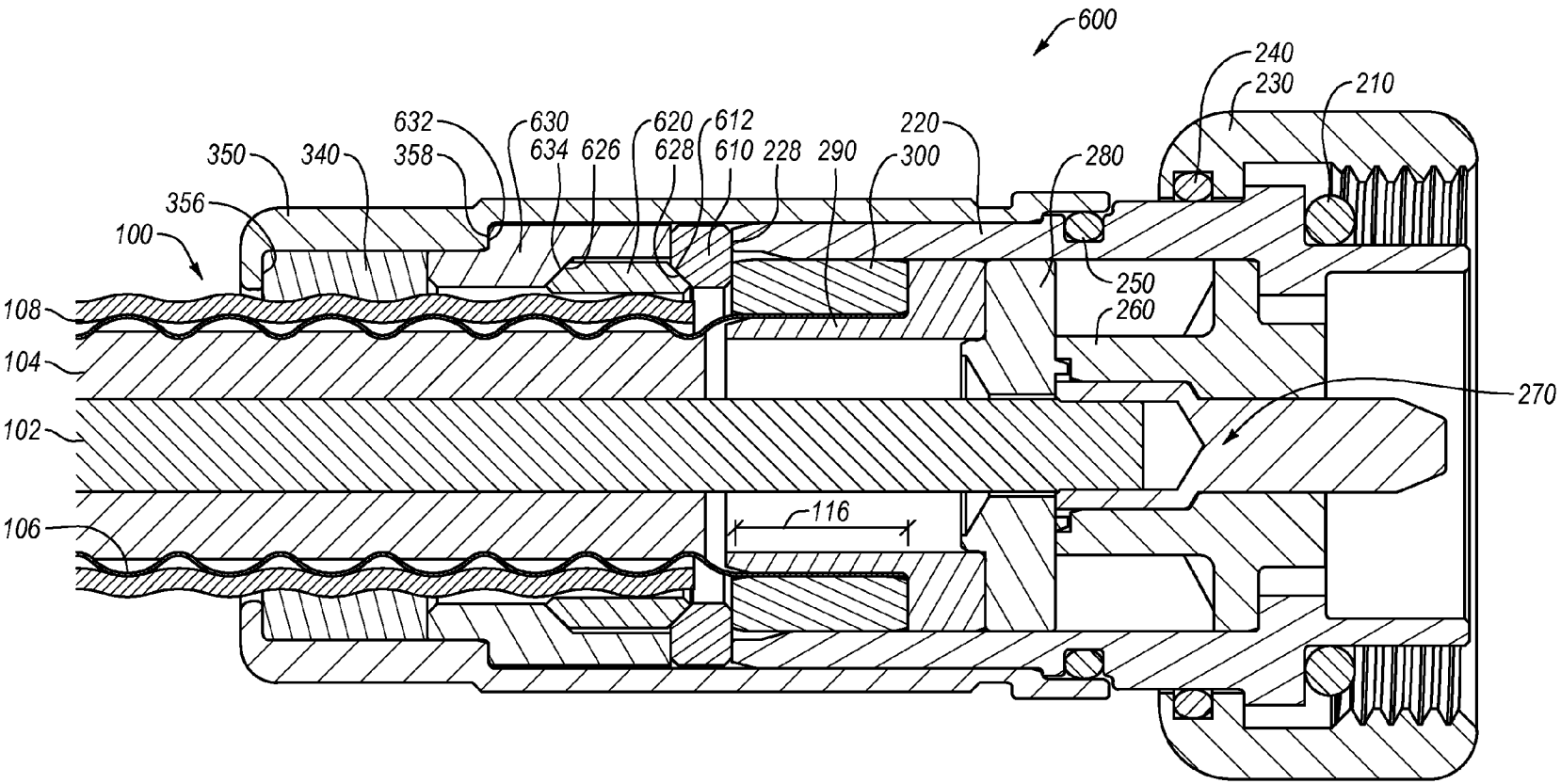
FIG. 5C is a cross-sectional side view of the terminal end of the example corrugated coaxial cable of FIG. 1C after having been inserted into the third alternative compression connector of FIG. 5A, with the third alternative compression connector being in an engaged position.

With reference now to FIGS. 5A-5C, a third alternative compression connector 600 is disclosed. The third alternative compression connector 600 is identical to the compression connector 200 except that the washer 310, the strain relief clamp 320, and the strain relief ring 330 have been replaced with a washer 610, a strain relief clamp 620, and a strain relief ring 630.

As disclosed in FIG. 5A, the strain relief clamp 620 defines a slot 622 running the length of the strain relief clamp 620. The strain relief clamp 620 also defines an engagement surface 624. In at least some example embodiments, the moisture seal 340 is formed from a material that is softer than the material from which the strain relief clamp 620 is formed. For example, the moisture seal 340 may be formed from rubber material while the strain relief clamp 620 is formed from an acetal homopolymer material. Further, in at least some example embodiments, the strain relief ring 630 is formed from brass.

With reference now to FIGS. 5B and 5C, additional aspects of the operation of the third alternative compression connector 600 are disclosed. FIG. 5B discloses the third alternative compression connector 600 in an initial open position, while FIG. 5C discloses the third alternative compression connector 600 after having been moved into an engaged position. As most of the components of the third alternative compression connector 600 are identical in form and function to the components of the example compression connector 200, the discussion below will focus primarily on those aspects of the operation of the third alternative compression connector 600 that differ from the operation of the example compression connector 200.

As disclosed in FIG. 5B, the terminal end of the coaxial cable 100 of FIG. 1C can be inserted into the third alternative compression connector 600 through the compression sleeve 350. Once inserted, the strain relief clamp 620 and the moisture seal 340 surround the jacket 108 of the coaxial cable 100.

As disclosed in FIGS. 5B and 5C, the third alternative compression connector 600 is moved into the engaged position by sliding the compression sleeve 350 axially along the connector body 220 toward the connector nut 230. As the third alternative compression connector 600 is moved into the engaged position, the shoulder 356 of the compression sleeve 350 axially biases against the moisture seal 340, which axially biases against the strain relief ring 630, which axially biases against the strain relief clamp 620, which axially biases against the washer 610, which axially forces the clamp 300 into the smaller-diameter connector body 220 so as to radially compress the increased-diameter cylindrical section 116 of the outer conductor 106 between the clamp 300 and the mandrel 290.

Also, as the third alternative compression connector 600 is moved into the engaged position, the distal end 228 of the connector body 220 axially biases against the washer 610, which axially biases against the strain relief clamp 620, which axially biases against the strain relief ring 630, which axially biases against the moisture seal 340 until the shoulder 358 of the compression sleeve 350 abuts a shoulder 632 of the strain relief ring 630. The axial force of the strain relief ring 630 combined with the opposite axial force of the washer 610 axially forces a first tapered surface 626 of the strain relief clamp 620 to interact with a corresponding tapered surface 634 of the strain relief ring 630, and a second tapered surface 628 of the strain relief clamp 620 to interact with a corresponding tapered surface 612 of the washer 610, in order to exert a first inwardly-directed radial force against the jacket 108 by narrowing or closing the slot 622 (see FIG. 5A). The first tapered surface 626 of the strain relief clamp 620 tapers outwardly toward the clamp 300. The second tapered surface 628 of the strain relief clamp 620 tapers inwardly toward the clamp 300.

Moreover, as the third alternative compression connector 600 is moved into the engaged position, the strain relief ring 630 axially biases against the moisture seal 340 and thereby axially compresses the moisture seal 340 causing the moisture seal 340 to exert a second inwardly-directed radial force against the jacket 108 of the coaxial cable 100, thus sealing the compression sleeve 350 to the jacket 108 of the coaxial cable 100.

In at least some example embodiments, the first inwardly-directed radial force is greater than the second inwardly-directed radial force. This difference in inwardly-directed radial force may be due to any of the various reasons discussed above in connection with the differences in inwardly-directed radial force exerted by the moisture seal 340 and the strain relief clamp 320. The inwardly-directed radial force exerted by the strain relief clamp 620 relieves strain on the coaxial cable 100 from being transferred to the mechanical and electrical contacts between the outer conductor 106, the clamp 300, and the mandrel 290, in a similar fashion as the strain relief clamp 320 discussed above.

VI. Fourth Alternative Compression Connector

Figure 6A:
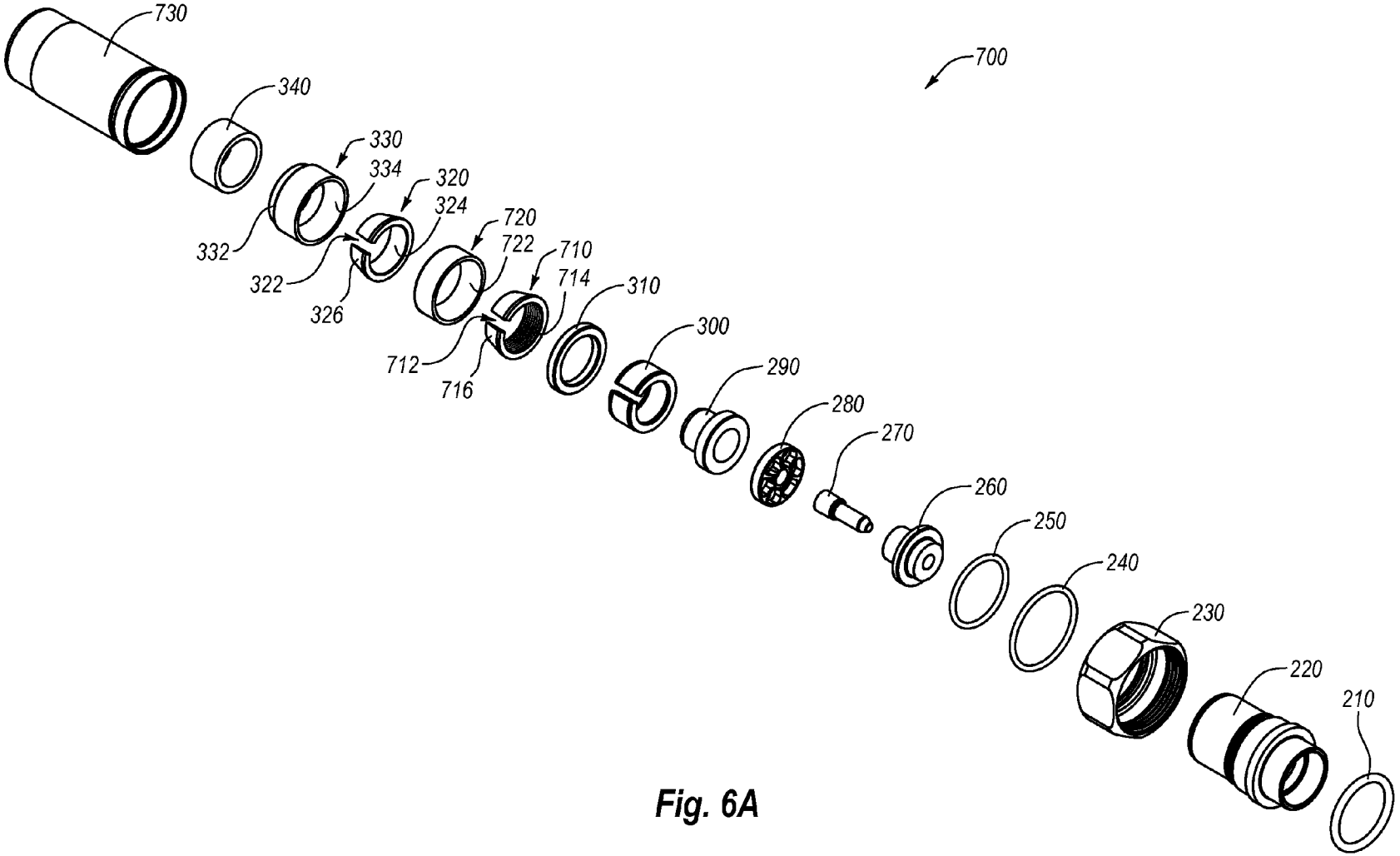
FIG. 6A is an exploded view of a fourth alternative compression connector.
Figure 6B:
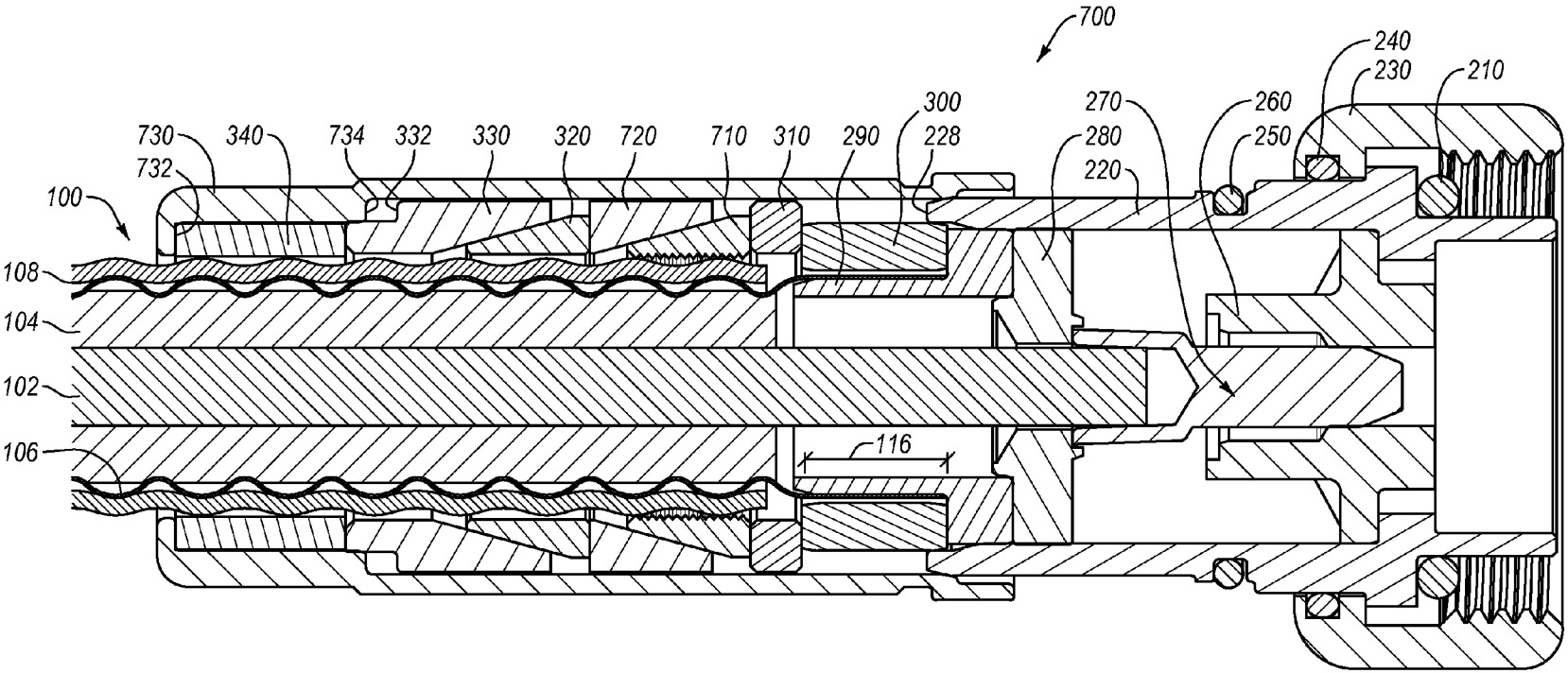
FIG. 6B is a cross-sectional side view of the terminal end of the example corrugated coaxial cable of FIG. 1C after having been inserted into the fourth alternative compression connector of FIG. 6A, with the fourth alternative compression connector being in an open position.
Figure 6C:
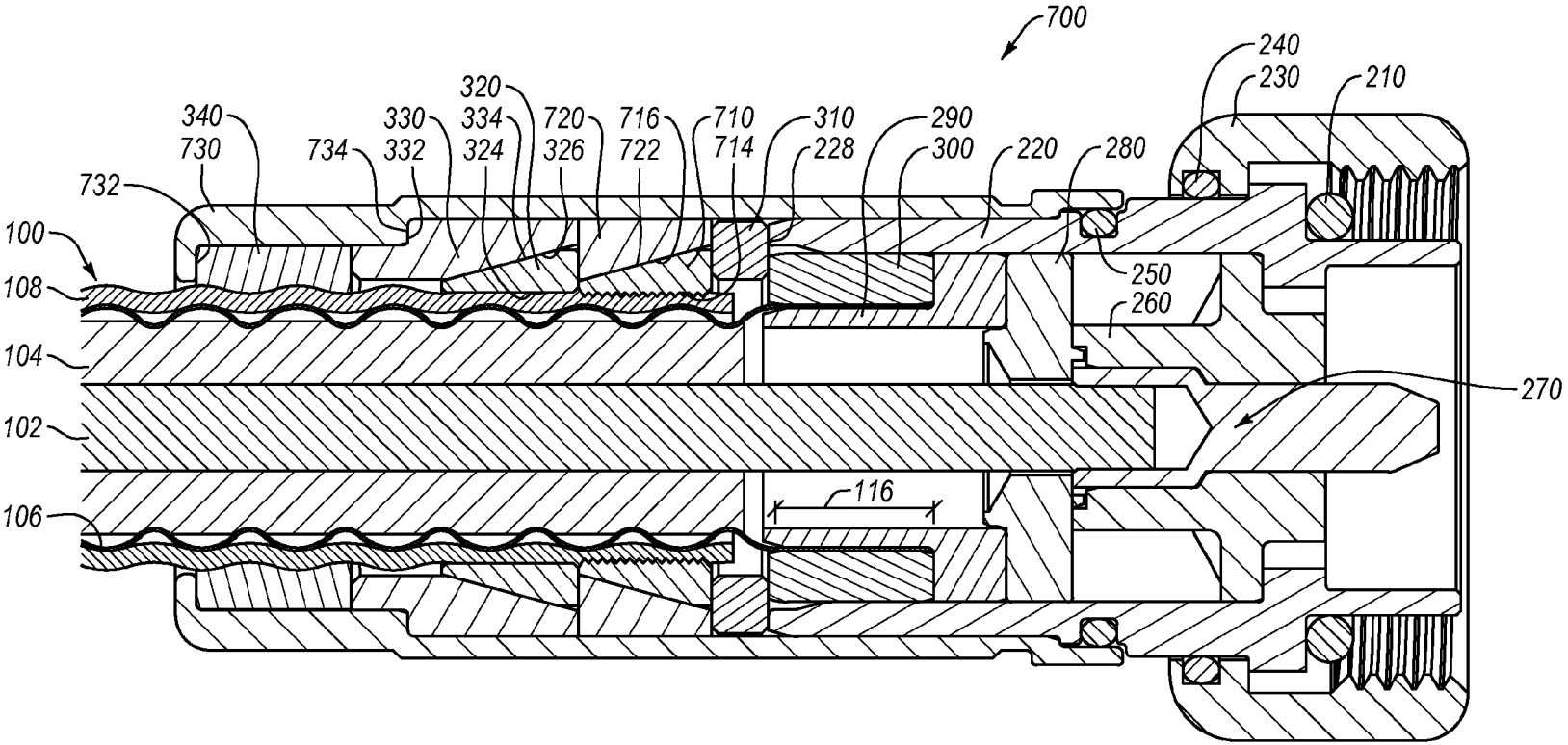
FIG. 6C is a cross-sectional side view of the terminal end of the example corrugated coaxial cable of FIG. 1C after having been inserted into the fourth alternative compression connector of FIG. 6A, with the fourth alternative compression connector being in an engaged position.

With reference now to FIGS. 6A-6C, a fourth alternative compression connector 700 is disclosed. The fourth alternative compression connector 700 is identical to the compression connector 200 except that the compression sleeve 350 has been replaced with a compression sleeve 730. In addition, a second strain relief clamp 710 and a second strain relief ring 720 have been added to the fourth alternative compression connector 700.

As disclosed in FIG. 6A, the strain relief clamp 710 defines a slot 712 running the length of the strain relief clamp 710. The strain relief clamp 710 also defines an engagement surface 714. The engagement surface 714 includes teeth to better engage the jacket 108 of the coaxial cable 100 (see FIG. 6C). In at least some example embodiments, the moisture seal 340 is formed from a material that is softer than the material from which the strain relief clamp 710 is formed. For example, the moisture seal 340 may be formed from rubber material while the strain relief clamp 710 is formed from an acetal homopolymer material. Further, in at least some example embodiments, the strain relief ring 720 is formed from brass.

With reference now to FIGS. 6B and 6C, additional aspects of the operation of the fourth alternative compression connector 700 are disclosed. FIG. 6B discloses the fourth alternative compression connector 700 in an initial open position, while FIG. 6C discloses the fourth alternative compression connector 700 after having been moved into an engaged position. As most of the components of the fourth alternative compression connector 700 are identical in form and function to the components of the example compression connector 200, the discussion below will focus primarily on those aspects of the operation of the fourth alternative compression connector 700 that differ from the operation of the example compression connector 200.

As disclosed in FIG. 6B, the terminal end of the coaxial cable 100 of FIG. 1C can be inserted into the fourth alternative compression connector 700 through the compression sleeve 730. Once inserted, the moisture seal 340, the strain relief clamp 320, and the strain relief clamp 710 surround the jacket 108 of the coaxial cable 100.

As disclosed in FIGS. 6B and 6C, the fourth alternative compression connector 700 is moved into the engaged position by sliding the compression sleeve 730 axially along the connector body 220 toward the connector nut 230. As the fourth alternative compression connector 700 is moved into the engaged position, a shoulder 732 of the compression sleeve 730 axially biases against the moisture seal 340, which axially biases against the strain relief ring 330, which axially biases against the strain relief clamp 320, which axially biases against the strain relief ring 720, which axially biases against the strain relief clamp 710, which axially biases against the washer 310, which axially forces the clamp 300 into the smaller-diameter connector body 220 so as to radially compress the increased-diameter cylindrical section 116 of the outer conductor 106 between the clamp 300 and the mandrel 290.

Also, as the fourth alternative compression connector 700 is moved into the engaged position, the distal end 228 of the connector body 220 axially biases against the washer 310, which axially biases against the strain relief clamp 710, which axially biases against the strain relief ring 720, which axially biases against the strain relief clamp 320, which axially biases against the strain relief ring 330, which axially biases against the moisture seal 340 until a shoulder 734 of the compression sleeve 730 abuts the shoulder 332 of the strain relief ring 330. The axial force of the strain relief ring 330 combined with the opposite axial force of the washer 310 axially forces a tapered surface 326 of the strain relief clamp 320 to interact with a corresponding tapered surface 334 of the strain relief ring 330, and a tapered surface 716 of the strain relief clamp 710 to interact with a corresponding tapered surface 722 of the strain relief ring 720, in order to exert a first inwardly-directed radial force against the jacket 108 by narrowing or closing the slots 322 and 712 (see FIG. 6A). The tapered surfaces 334 and 722 of the strain relief clamps 330 and 720, respectively, taper outwardly toward the clamp 300.

Moreover, as the fourth alternative compression connector 700 is moved into the engaged position, the strain relief ring 330 axially biases against the moisture seal 340 and thereby axially compresses the moisture seal 340 causing the moisture seal 340 to exert a second inwardly-directed radial force against the jacket 108 of the coaxial cable 100, thus sealing the compression sleeve 730 to the jacket 108 of the coaxial cable 100.

In at least some example embodiments, the first inwardly-directed radial force is greater than the second inwardly-directed radial force. This difference in inwardly-directed radial force may be due to any of the various reasons discussed above in connection with the differences in inwardly-directed radial force exerted by the moisture seal 340 and the strain relief clamp 320. The inwardly-directed radial force exerted by the strain relief clamps 320 and 710 relieves strain on the coaxial cable 100 from being transferred to the mechanical and electrical contacts between the outer conductor 106, the clamp 300, and the mandrel 290, in a similar fashion as the strain relief clamp 320 discussed above.

VII. Fifth Alternative Compression Connector

Figure 7A:
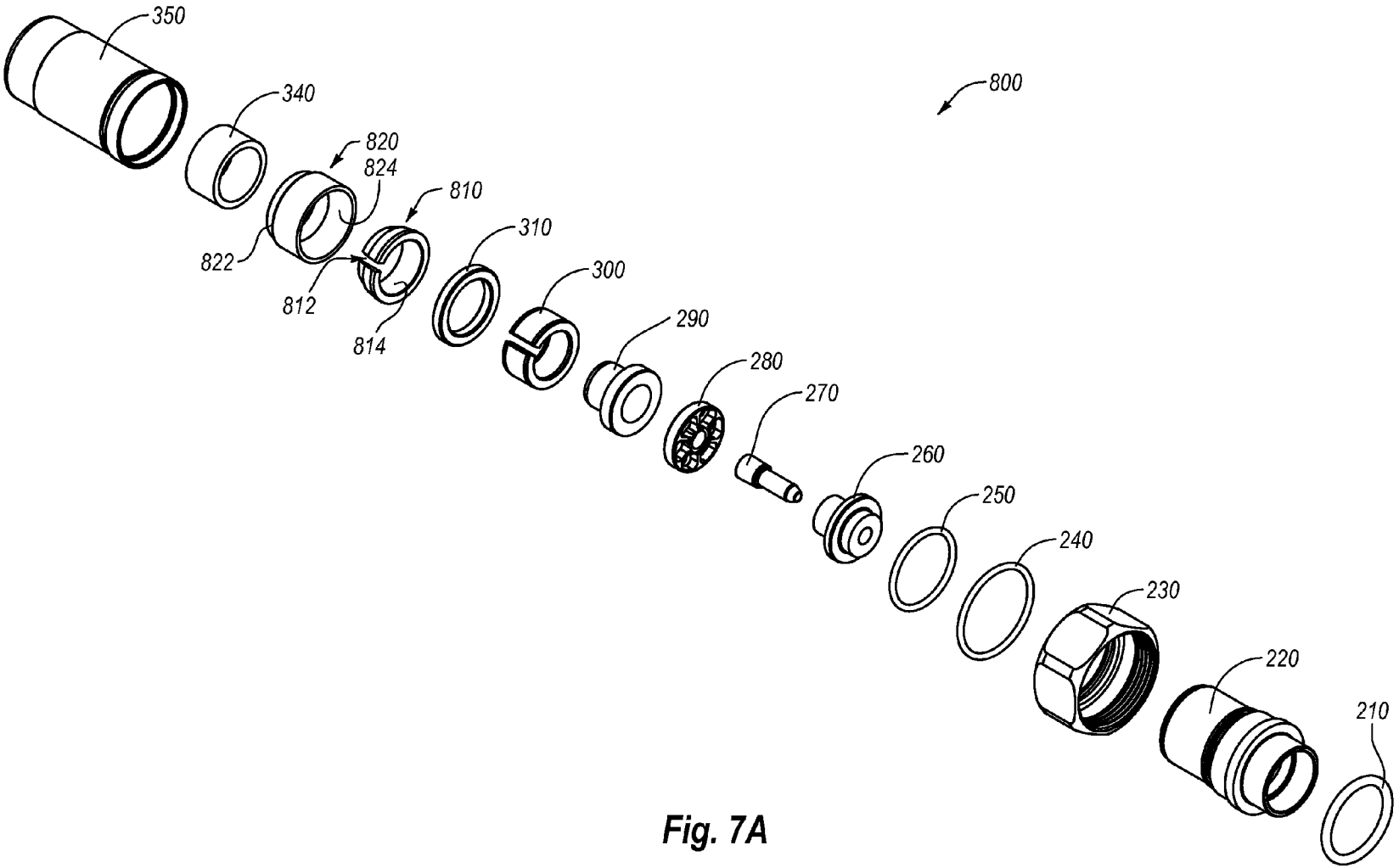
FIG. 7A is an exploded view of a fifth alternative compression connector.
Figure 7B:
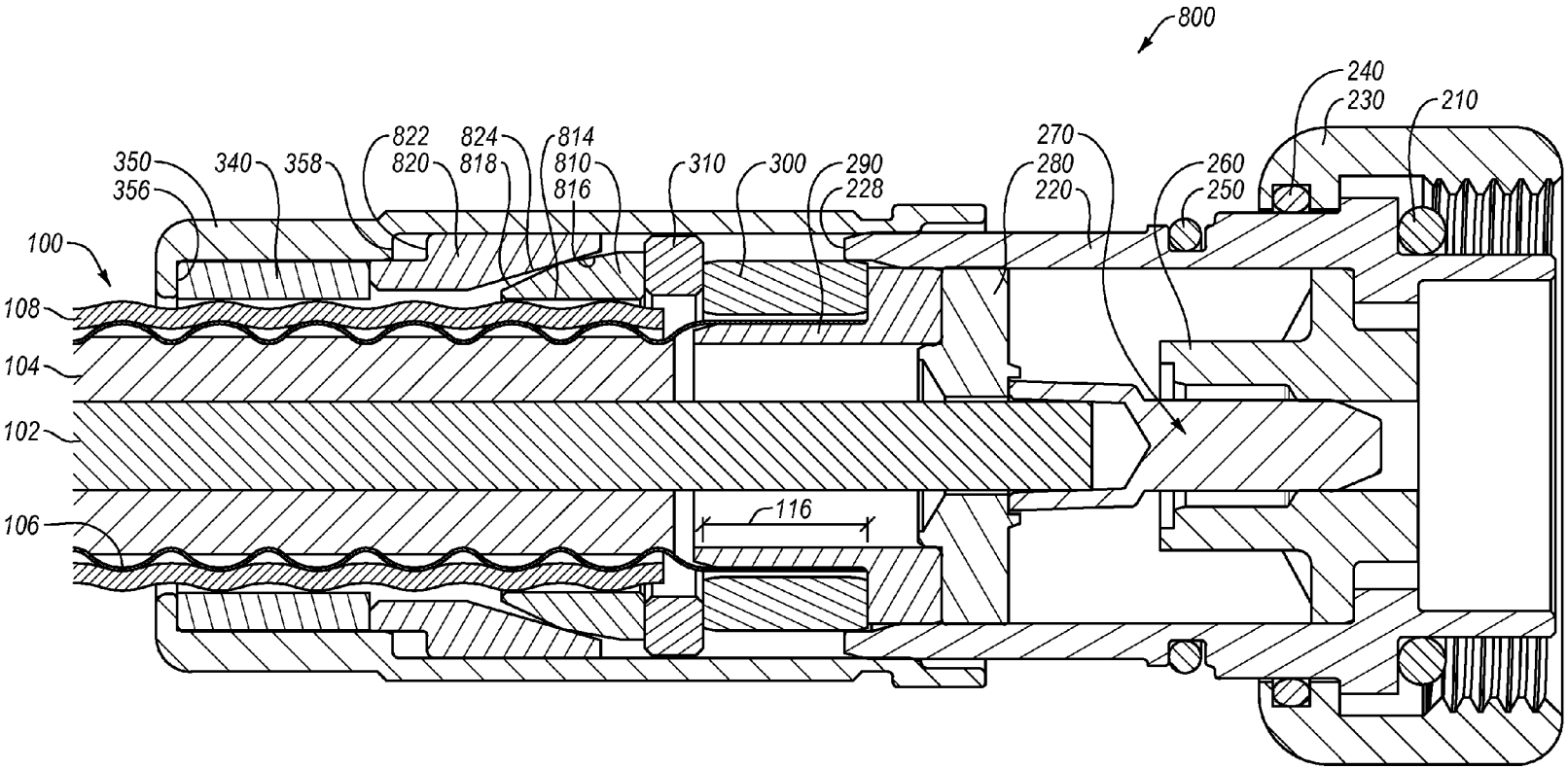
FIG. 7B is a cross-sectional side view of the terminal end of the example corrugated coaxial cable of FIG. 1C after having been inserted into the fifth alternative compression connector of FIG. 7A, with the fifth alternative compression connector being in an open position.
Figure 7C:
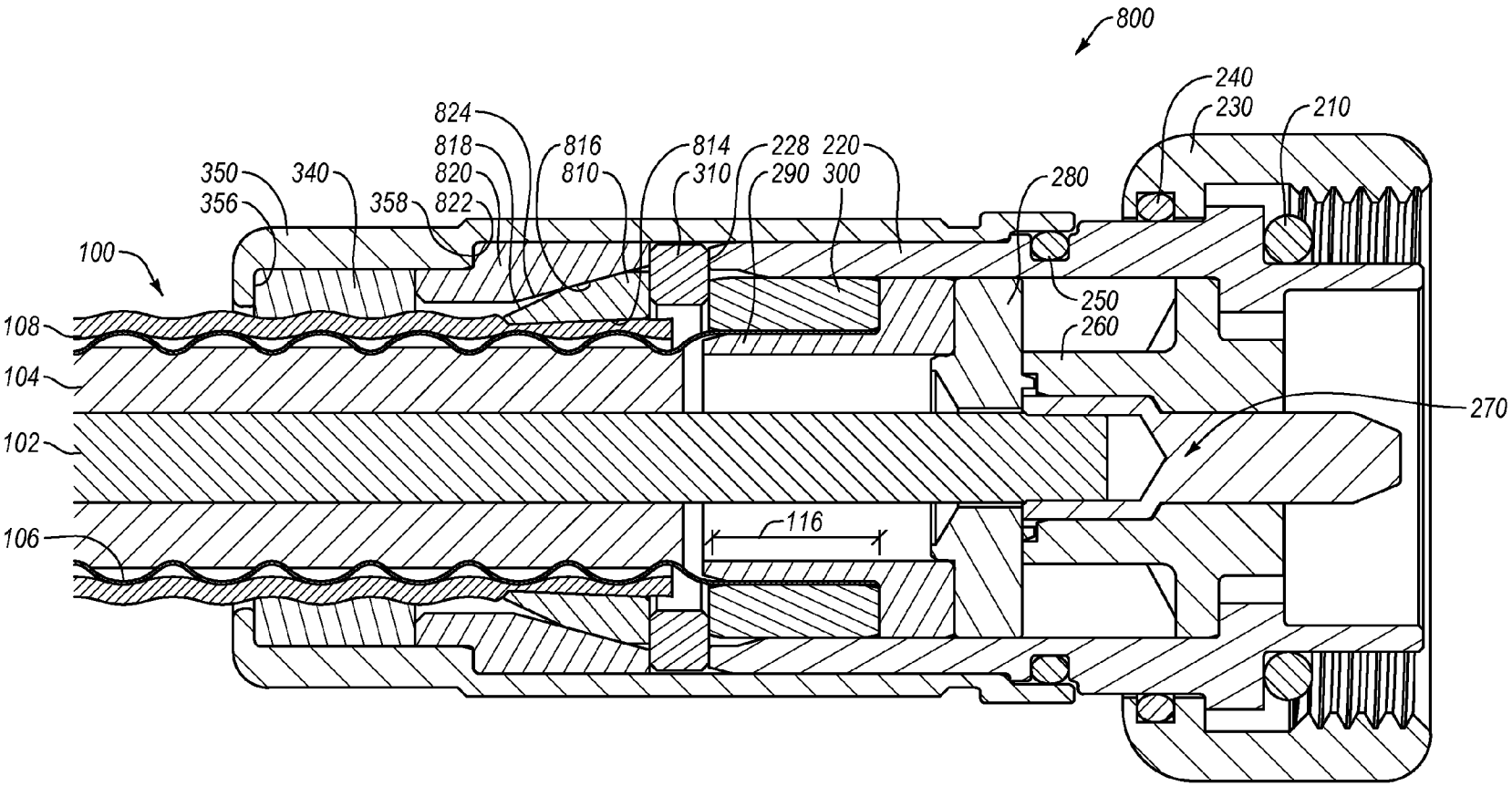
FIG. 7C is a cross-sectional side view of the terminal end of the example corrugated coaxial cable of FIG. 1C after having been inserted into the fifth alternative compression connector of FIG. 7A, with the fifth alternative compression connector being in an engaged position.

With reference now to FIGS. 7A-7C, a fifth alternative compression connector 800 is disclosed. The fifth alternative compression connector 800 is identical to the compression connector 200 except that the strain relief clamp 320 has been replaced with a strain relief clamp 810 and the strain relief ring 330 has been replaced with a strain relief ring 820.

As disclosed in FIG. 7A, the strain relief clamp 810 defines a slot 812 running the length of the strain relief clamp 810. The strain relief clamp 810 also defines an engagement surface 814. In at least some example embodiments, the moisture seal 340 is formed from a material that is softer than the material from which the strain relief clamp 810 is formed. For example, the moisture seal 340 may be formed from rubber material while the strain relief clamp 810 is formed from an acetal homopolymer material. Further, in at least some example embodiments, the strain relief ring 820 is formed from brass.

With reference now to FIGS. 7B and 7C, additional aspects of the operation of the fifth alternative compression connector 800 are disclosed. FIG. 7B discloses the fifth alternative compression connector 800 in an initial open position, while FIG. 7C discloses the fifth alternative compression connector 800 after having been moved into an engaged position. As most of the components of the fifth alternative compression connector 800 are identical in form and function to the components of the example compression connector 200, the discussion below will focus primarily on those aspects of the operation of the fifth alternative compression connector 800 that differ from the operation of the example compression connector 200.

As disclosed in FIG. 7B, the terminal end of the coaxial cable 100 of FIG. 1C can be inserted into the fifth alternative compression connector 800 through the compression sleeve 350. Once inserted, the moisture seal 340 and the strain relief clamp 810 surround the jacket 108 of the coaxial cable 100.

As disclosed in FIGS. 7B and 7C, the fifth alternative compression connector 800 is moved into the engaged position by sliding the compression sleeve 350 axially along the connector body 220 toward the connector nut 230. As the fifth alternative compression connector 800 is moved into the engaged position, a shoulder 356 of the compression sleeve 350 axially biases against the moisture seal 340, which axially biases against the strain relief ring 820, which axially biases against the strain relief clamp 810, which axially biases against the washer 310, which axially forces the clamp 300 into the smaller-diameter connector body 220 so as to radially compress the increased-diameter cylindrical section 116 of the outer conductor 106 between the clamp 300 and the mandrel 290.

Also, as the fifth alternative compression connector 800 is moved into the engaged position, the distal end 228 of the connector body 220 axially biases against the washer 310, which axially biases against the strain relief clamp 810, which axially biases against the strain relief ring 820, which axially biases against the moisture seal 340 until a shoulder 358 of the compression sleeve 350 abuts the shoulder 822 of the strain relief ring 820. The axial force of the strain relief ring 820 combined with the opposite axial force of the washer 310 axially forces first and/or second tapered surfaces 816 and 818 of the strain relief clamp 810 to interact with a corresponding tapered surface 824 of the strain relief ring 820 in order to exert a first inwardly-directed radial force against the jacket 108 by narrowing or closing the slot 812 (see FIG. 7A). The tapered surfaces 816, 818, and 824 taper outwardly toward the clamp 300.

Further, the first and second tapered surfaces 816 and 818 taper at different angles, neither of which matches the angle of the corresponding tapered surface 334 of the strain relief ring 330, which facilitates progressive engagement of the strain relief clamp 810 with the strain relief ring 820. In particular, the tapered surface 824 of the strain relief ring 820 will first engage a portion of the first tapered surface 816 of the strain relief clamp 810, and then subsequently engage a portion of the second tapered surface 818 of the strain relief clamp 810. This progressive engagement of the strain relief clamp 810 facilitates a progressively increased inwardly-directed radial force against the jacket 108 of the coaxial cable 100.

Moreover, as the fifth alternative compression connector 800 is moved into the engaged position, the strain relief ring 820 axially biases against the moisture seal 340 and thereby axially compresses the moisture seal 340 causing the moisture seal 340 to exert a second inwardly-directed radial force against the jacket 108 of the coaxial cable 100, thus sealing the compression sleeve 350 to the jacket 108 of the coaxial cable 100.

In at least some example embodiments, the first inwardly-directed radial force is greater than the second inwardly-directed radial force. This difference in inwardly-directed radial force may be due to any of the various reasons discussed above in connection with the differences in inwardly-directed radial force exerted by the moisture seal 340 and the strain relief clamp 320. The inwardly-directed radial force exerted by the strain relief clamp 810 relieves strain on the coaxial cable 100 from being transferred to the mechanical and electrical contacts between the outer conductor 106, the clamp 300, and the mandrel 290, in a similar fashion as the strain relief clamp 320 discussed above.

VIII. Sixth Alternative Compression Connector

Figure 8A:
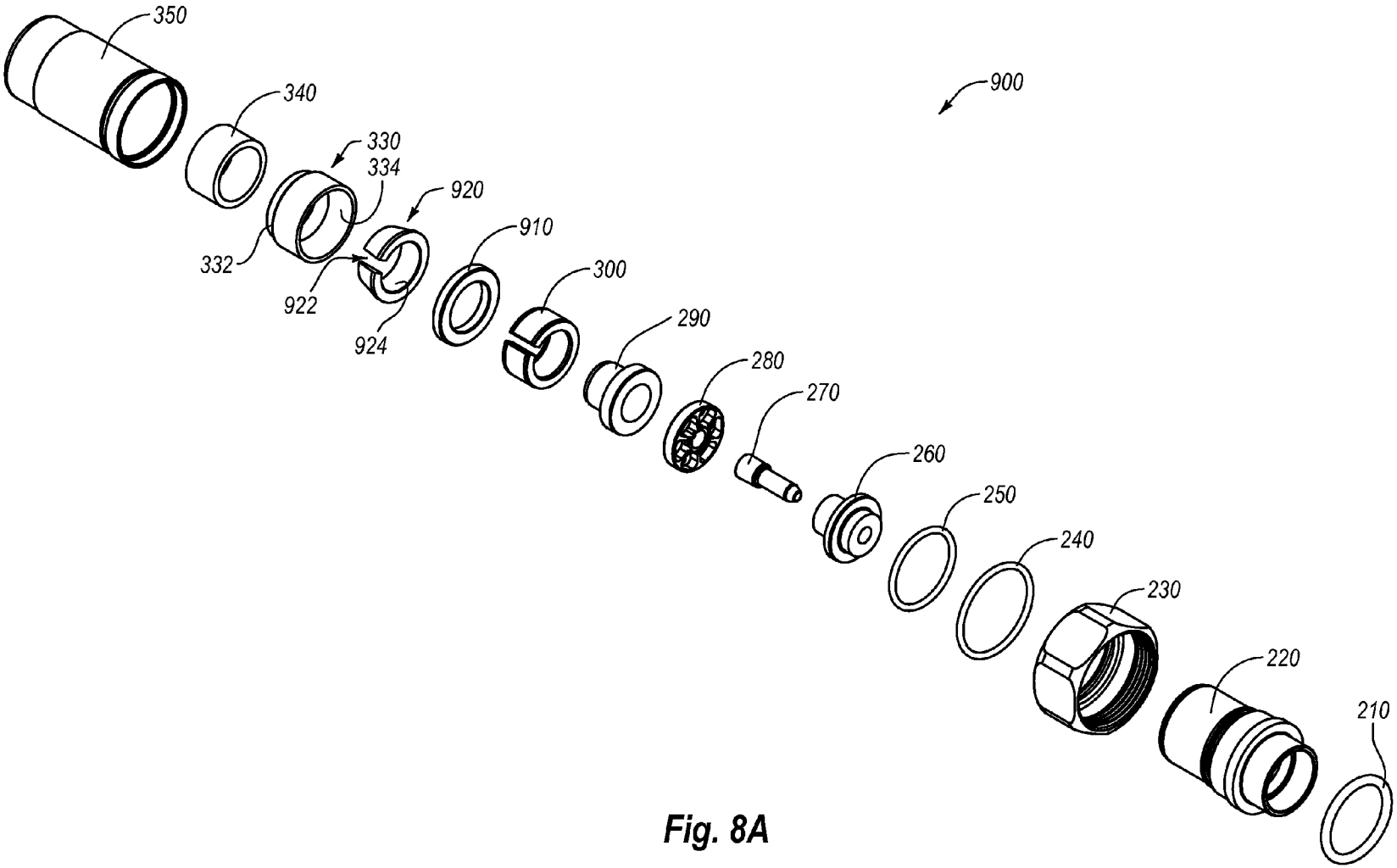
FIG. 8A is an exploded view of a sixth alternative compression connector.
Figure 8B:
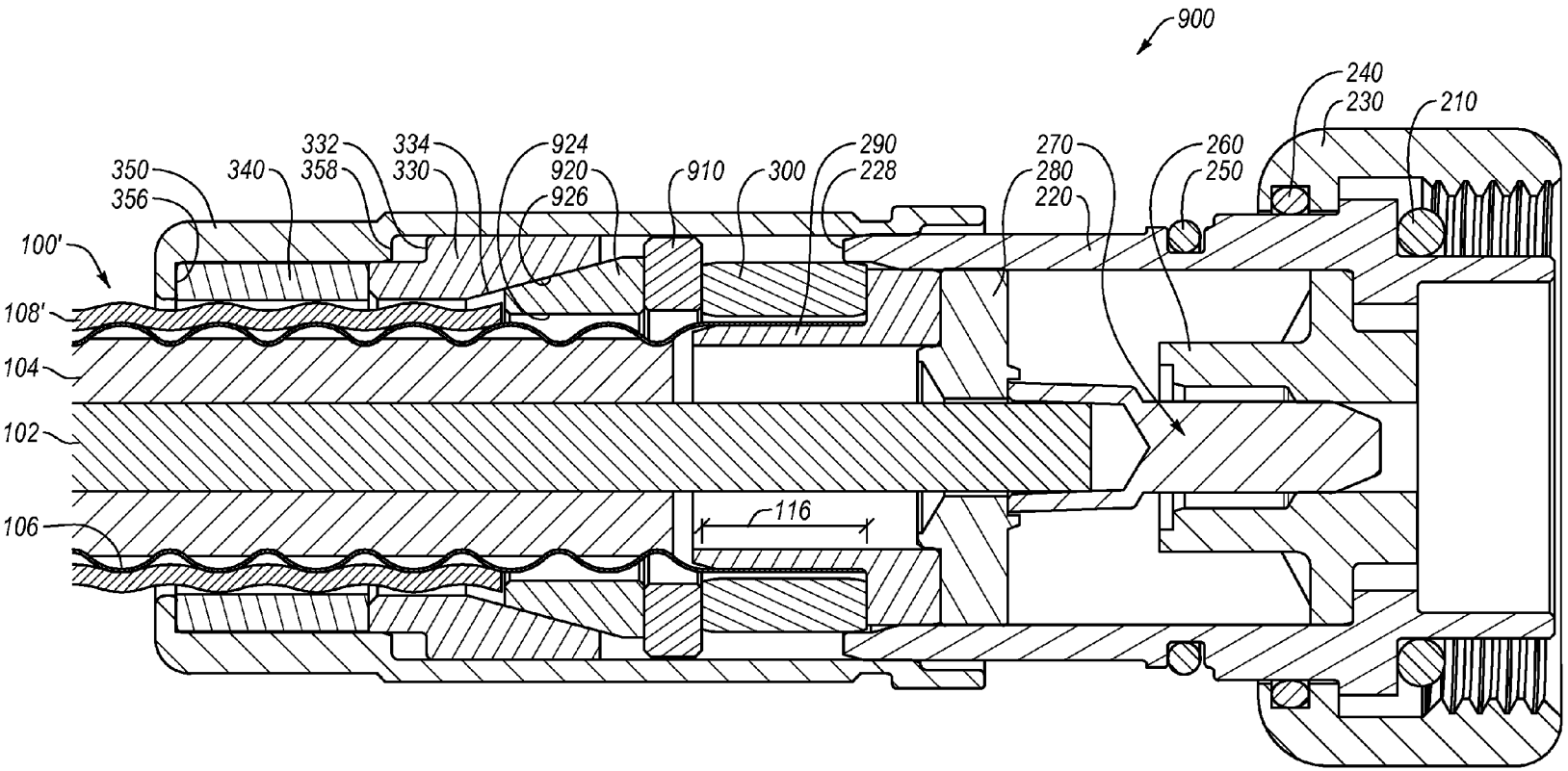
FIG. 8B is a cross-sectional side view of the terminal end of an alternative corrugated coaxial cable after having been inserted into the sixth alternative compression connector of FIG. 8A, with the sixth alternative compression connector being in an open position.
Figure 8C:
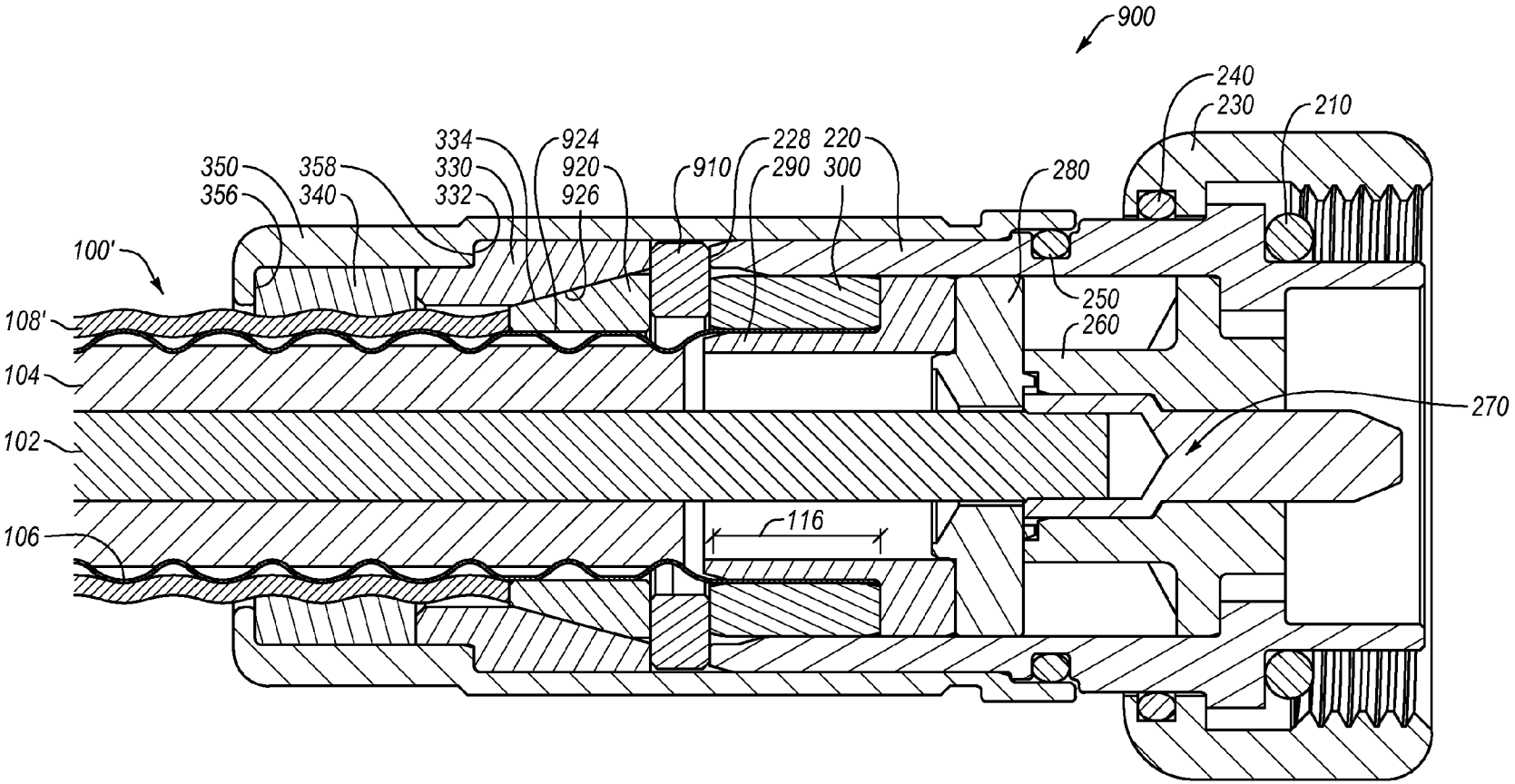
FIG. 8C is a cross-sectional side view of the terminal end the alternative corrugated coaxial cable of FIG. 8B after having been inserted into the sixth alternative compression connector of FIG. 8A, with the sixth alternative compression connector being in an engaged position.

With reference now to FIGS. 8A-8C, a sixth alternative compression connector 900 is disclosed. The sixth alternative compression connector 900 is identical to the compression connector 200 except that the washer 310 has been replaced with the washer 910 and the strain relief clamp 320 has been replaced with the strain relief clamp 920.

As disclosed in FIG. 8A, the strain relief clamp 920 defines a slot 922 running the length of the strain relief clamp 920. The strain relief clamp 920 also defines an engagement surface 924. In at least some example embodiments, the moisture seal 340 is formed from a material that is softer than the material from which the strain relief clamp 920 is formed. For example, the moisture seal 340 may be formed from rubber material while the strain relief clamp 920 is formed from an acetal homopolymer material.

With reference now to FIGS. 8B and 8C, additional aspects of the operation of the sixth alternative compression connector 900 are disclosed. FIG. 8B discloses the sixth alternative compression connector 900 in an initial open position, while FIG. 8C discloses the sixth alternative compression connector 900 after having been moved into an engaged position. As most of the components of the sixth alternative compression connector 900 are identical in form and function to the components of the example compression connector 200, the discussion below will focus primarily on those aspects of the operation of the sixth alternative compression connector 800 that differ from the operation of the example compression connector 200.

As disclosed in FIG. 8B, the terminal end of an alternative coaxial cable 100' can be inserted into the sixth alternative compression connector 900 through the compression sleeve 350. Once inserted, the moisture seal 340 and the strain relief clamp 920 surround the jacket 108' of the coaxial cable 100'. The only difference between the coaxial cables 100 and 100' is that the jacket 108' of the alternative coaxial cable 100' is stripped back further than the jacket 108.

As disclosed in FIGS. 8B and 8C, the sixth alternative compression connector 900 is moved into the engaged position by sliding the compression sleeve 350 axially along the connector body 220 toward the connector nut 230. As the sixth alternative compression connector 900 is moved into the engaged position, a shoulder 356 of the compression sleeve 350 axially biases against the moisture seal 340, which axially biases against the strain relief ring 330, which axially biases against the strain relief clamp 920, which axially biases against the washer 910, which axially forces the clamp 300 into the smaller-diameter connector body 220 so as to radially compress the increased-diameter cylindrical section 116 of the outer conductor 106 between the clamp 300 and the mandrel 290.

Also, as the sixth alternative compression connector 900 is moved into the engaged position, the distal end 228 of the connector body 220 axially biases against the washer 910, which axially biases against the strain relief clamp 920, which axially biases against the strain relief ring 330, which axially biases against the moisture seal 340 until a shoulder 358 of the compression sleeve 350 abuts the shoulder 332 of the strain relief ring 330. The axial force of the strain relief ring 330 combined with the opposite axial force of the washer 910 axially forces the tapered surface 926 of the strain relief clamp 920 to interact with a corresponding tapered surface 334 of the strain relief ring 330 in order to exert a first inwardly-directed radial force against the outer conductor by narrowing or closing the slot 922 (see FIG. 8A). The tapered surface 926 tapers outwardly toward the clamp 300.

The washer 910 and the strain relief clamp 920 cooperate to enable the connector 900 to engage coaxial cables having a variety of outside diameters and/or to engage the outer conductor of a coaxial cable. For example, as disclosed in FIGS. 8B and 8C, the jacket 108' of an alternative coaxial cable 100' is stripped back such that the strain relief clamp 920 is able to engage the outer conductor 106 directly.

Moreover, as the sixth alternative compression connector 900 is moved into the engaged position, the strain relief ring 330 axially biases against the moisture seal 340 and thereby axially compresses the moisture seal 340 causing the moisture seal 340 to exert a second inwardly-directed radial force against the jacket 108' of the coaxial cable 100', thus sealing the compression sleeve 350 to the jacket 108' of the coaxial cable 100'.

In at least some example embodiments, the first inwardly-directed radial force is greater than the second inwardly-directed radial force. This difference in inwardly-directed radial force may be due to any of the various reasons discussed above in connection with the differences in inwardly-directed radial force exerted by the moisture seal 340 and the strain relief clamp 320. The inwardly-directed radial force exerted by the strain relief clamp 920 relieves strain on the coaxial cable 100' from being transferred to the mechanical and electrical contacts between the outer conductor 106, the clamp 300, and the mandrel 290, in a similar fashion as the strain relief clamp 320 discussed above.

IX. Other Alternative Compression Connectors

It is understood that the order of the components disclosed in FIGS. 2A-8C may be altered in some example embodiments. For example, instead of the strain relief clamp in each of these drawings being positioned between the moisture seal 340 and the clamp 300, the moisture seal 340 may be positioned between the clamp 300 and the strain relief clamp.

In addition, it is also understood that, in at least some example embodiments, the moisture seal 340 and each of the various strain relief clamps may be integrally formed as a single part. For example, a single part may include a portion that functions as a moisture seal and another integral portion that functions as a strain relief clamp.

Further, although the engagement surfaces of the various strain relief clamps are disclosed in FIGS. 2B-2D, 4A-5C, and 7A-8C as substantially smooth cylindrical surfaces, it is contemplated that portions of the engagement surfaces may be non-cylindrical. For example, portions of the engagement surfaces may include steps (see, for example, FIGS. 3A and 3B), grooves, ribs, or teeth (see, for example FIGS. 8A-8C) in order better engage the jacket 108 of the coaxial cable 100 or the outer conductor 106 of the alternative coaxial cable 100'.

Further, although the various strain relief clamps disclosed in FIGS. 2B-8C substantially surround and engage the jacket 108 or the outer conductor 106, it is understood that the stripped portion of the jacket 108 may extend into at least a portion of one or more of the various strain relief clamps. Accordingly, any one of the various strain relief clamps may exert an inwardly-directed radial force against the coaxial cable 100 along the jacket 108, the outer conductor 106, or both the jacket 108 and the outer conductor 106.

Also, the clamp 300 disclosed in FIGS. 2B-8C is only one example of an outer conductor clamp. Likewise, the clamp portion 274 of the conductive pin 270 is only one example of an inner conductor clamp. It is understood that the various strain relief clamps disclosed in FIGS. 2B-8C can be employed in connection with various other types of internal conductor clamps and/or external conductor clamps. For example, although the clamp 300 generally requires that the coaxial cable 100 be prepared with an increased-diameter cylindrical section 116, as disclosed in FIG. 1C, the clamp 300 could instead be replaced with a clamp that is configured to achieve mechanical and electrical contact with a corrugated section of the outer conductor 106.

Finally, it is understood that although the example coaxial cable connectors disclosed in the figures are compression connectors, the various strain relief clamps disclosed in the figures can be beneficially employed in similar connectors in which the connectors are engaged using a screw mechanism that is built into the connectors instead of using a separate compression tool.

The example embodiments disclosed herein may be embodied in other specific forms. The example embodiments disclosed herein are to be considered in all respects only as illustrative and not restrictive.

What is claimed is:

1. A coaxial cable connector for terminating a coaxial cable, the coaxial cable comprising an inner conductor, an insulating layer surrounding the inner conductor, an outer conductor surrounding the insulating layer, and a jacket surrounding the outer conductor, the coaxial cable connector comprising:

an inner conductor clamp configured to engage the inner conductor;

an outer conductor clamp configured to engage the outer conductor;

a strain relief clamp configured to exert a first inwardly-directed radial force against the coaxial cable; and a moisture seal configured to exert a second inwardly-directed radial force against the jacket, the first force being greater than the second force.

2. The coaxial cable connector as recited in claim 1, wherein the moisture seal and the strain relief clamp are integrally formed as a single part.

3. The coaxial cable connector as recited in claim 1, wherein the moisture seal is positioned between the outer conductor clamp and the strain relief clamp.

4. The coaxial cable connector as recited in claim 1, wherein an engagement surface of the strain relief clamp has a stepped configuration.

5. The coaxial cable connector as recited in claim 1, wherein an engagement surface of the strain relief clamp includes teeth.

6. The coaxial cable connector as recited in claim 1, wherein the strain relief clamp includes a tapered surface configured to interact with a corresponding tapered surface of the coaxial cable connector in order to exert the first inwardly-directed radial force against the coaxial cable.

7. The coaxial cable connector as recited in claim 6, wherein the strain relief clamp includes a second tapered surface configured to interact with a corresponding second tapered surface of the coaxial cable connector in order to exert the first inwardly-directed radial force against the coaxial cable.

8. The coaxial cable connector as recited in claim 6, wherein the tapered surface of the strain relief clamp tapers inwardly toward the outer conductor clamp.

9. The coaxial cable connector as recited in claim 6, wherein the tapered surface of the strain relief clamp tapers outwardly toward the outer conductor clamp.

10. A coaxial cable connector for terminating a coaxial cable, the coaxial cable comprising an inner conductor, an insulating layer surrounding the inner conductor, an outer conductor surrounding the insulating layer, and a jacket surrounding the outer conductor, the coaxial cable connector comprising:

an inner conductor clamp configured to engage the inner conductor;

an outer conductor clamp configured to compress the outer conductor against an internal connector structure;

a moisture seal configured to engage the jacket; and a strain relief clamp configured to engage the coaxial cable, the strain relief clamp not surrounding any portion of the internal connector structure.

11. The coaxial cable connector as recited in claim 10, wherein the strain relief clamp is positioned between the outer conductor clamp and the moisture seal.

12. The coaxial cable connector as recited in claim 10, wherein:

the strain relief clamp is configured to exert a first inwardly-directed radial force against the coaxial cable; and the moisture seal is configured to exert a second inwardly-directed radial force against the jacket, the second force being greater than the first force.

13. The coaxial cable connector as recited in claim 10, further comprising a second strain relief clamp configured to engage the coaxial cable.

14. The coaxial cable connector as recited in claim 10, wherein the coaxial cable connector is configured to be moved from an open position to an engaged position using a screw mechanism.

15. A terminated coaxial cable comprising:

a coaxial cable comprising:

an inner conductor;

an insulating layer surrounding the inner conductor;

an outer conductor surrounding the insulating layer; and a jacket surrounding the outer conductor; and a coaxial cable connector as recited in claim 10 attached to a terminal section of the coaxial cable.

16. A coaxial cable connector for terminating a coaxial cable, the coaxial cable comprising an inner conductor, an insulating layer surrounding the inner conductor, an outer conductor surrounding the insulating layer, and a jacket surrounding the outer conductor, the coaxial cable connector comprising:

an inner conductor clamp configured to engage the inner conductor;

an outer conductor clamp configured to compress the outer conductor against an internal connector structure;

a strain relief clamp configured to exert a first inwardly-directed radial force against the jacket; and a moisture seal configured to exert a second inwardly-directed radial force against the jacket, the first force being greater than the second force, the strain relief clamp not surrounding any portion of the internal connector or structure.

17. The coaxial cable connector as recited in claim 16, wherein the strain relief clamp includes first and second tapered surfaces configured to interact with a corresponding tapered surface of the coaxial cable connector in order to exert the first inwardly-directed radial force against the coaxial cable.

18. The coaxial cable connector as recited in claim 17, wherein the first and second tapered surfaces taper at different angles, neither of which matches the angle of the corresponding tapered surface of the coaxial cable connector.

19. A terminated coaxial cable comprising:

a coaxial cable comprising:

an inner conductor;

an insulating layer surrounding the inner conductor;

an outer conductor surrounding the insulating layer; and a jacket surrounding the outer conductor; and a coaxial cable connector as recited in claim 16 attached to a terminal section of the coaxial cable.

20. The terminated coaxial cable as recited in claim 19, further comprising a second coaxial cable connector as recited in claim 16 attached to a second terminal section of the coaxial cable.

* * * * *